US007861750B2

(12) United States Patent
Py et al.

(10) Patent No.: US 7,861,750 B2
(45) **Date of Patent: *Jan. 4, 2011**

(54) DISPENSER AND APPARATUS AND METHOD OF FILLING A DISPENSER

(75) Inventors: Daniel Py, Stamford, CT (US); Julian V. Chan, Spring Valley, NY (US)

(73) Assignee: Medical Instill Technologies, Inc., New Milford, CT (US)

( * ) Notice: Subject to any disclaimer, the term of this patent is extended or adjusted under 35 U.S.C. 154(b) by 93 days.

This patent is subject to a terminal disclaimer.

(21) Appl. No.: 12/025,362

(22) Filed: Feb. 4, 2008

(65) Prior Publication Data

US 2008/0142112 A1 Jun. 19, 2008

Related U.S. Application Data

(63) Continuation of application No. 11/349,873, filed on Feb. 8, 2006, now Pat. No. 7,328,729, which is a continuation of application No. 10/843,902, filed on May 12, 2004, now Pat. No. 6,997,219.

(60) Provisional application No. 60/469,677, filed on May 12, 2003, provisional application No. 60/471,592, filed on May 19, 2003, provisional application No. 60/488,355, filed on Jul. 17, 2003, provisional application No. 60/539,814, filed on Jan. 27, 2004.

(51) Int. Cl.
*B65B 1/04* (2006.01)

(52) U.S. Cl. ..... 141/314; 141/27; 141/98; 141/302

(58) Field of Classification Search ..... 141/1, 141/2, 18, 27, 59, 98, 313–316, 10, 114, 141/302; 222/251, 282

See application file for complete search history.

(56) References Cited

U.S. PATENT DOCUMENTS 1,392,600 A 10/1921 Rose (Continued)

FOREIGN PATENT DOCUMENTS

CA 1 123 792 5/1982

(Continued)

OTHER PUBLICATIONS

U.S. Appl. No. 11/938,103, filed Nov. 9, 2007, Py.
Amended claims filed Dec. 9, 2009 in U.S. Appl. No. 11/938,103.

*Primary Examiner*—Steven O Douglas
(74) *Attorney, Agent, or Firm*—McCarter & English, LLP

(57) ABSTRACT

A dispenser for holding multiple doses of fluids or other substances, and for dispensing the substances, has a vial, a flexible bladder received within the vial, and a variable volume storage chamber formed between the bladder and vial. A filling valve is coupled in fluid communication with the storage chamber and defines (1) a normally closed, fluid-tight position hermetically sealing the storage chamber from the ambient atmosphere, and (2) an open position allowing the passage of fluid through the valve both to evacuate the storage chamber and to introduce fluid through the valve to fill the storage chamber. A pump is coupled in fluid communication with the storage chamber for pumping fluids out of the storage chamber. A dispensing valve is coupled in fluid communication with the pump and defines (1) a normally closed, fluid-tight position preventing the passage of fluid out of the dispenser, and (2) an open position for dispensing pumped fluid therethrough. The sealed, empty dispenser is sterilized, such as by applying gamma radiation thereto. Then, the sterilized, sealed, empty dispenser is filled with fluid by engaging the filling valve with an evacuating/dispensing member to evacuate the storage chamber, and by introducing fluid from the filling member through the open filling valve and into the storage chamber. The filling member is withdrawn from the valve, and a spring moves the valve to a closed position to hermetically seal the fluid within the dispenser.

31 Claims, 9 Drawing Sheets

U.S. PATENT DOCUMENTS

| | | | |
|---|---|---|---|
| 1,471,091 | A | 10/1923 | Bessesen |
| 1,613,898 | A | 1/1927 | Metcalf et al. |
| 1,978,455 | A | 10/1934 | Geerlings |
| 2,014,881 | A | 9/1935 | Carlstrom |
| 2,128,035 | A | 8/1938 | Boetel |
| 2,317,270 | A | 4/1943 | Harris |
| 2,471,852 | A | 5/1949 | Bau |
| 2,522,403 | A | 9/1950 | Ross |
| 2,648,334 | A | 8/1953 | Brown et al. |
| 2,667,986 | A | 2/1954 | Perelson |
| 2,687,133 | A | 8/1954 | Schwarz |
| 2,715,980 | A | 8/1955 | Frick |
| 2,951,584 | A | 9/1960 | Bauer |
| 3,123,661 | A | 3/1964 | Roman |
| 3,136,440 | A | 6/1964 | Krug et al. |
| 3,160,329 | A | 12/1964 | Radic et al. |
| 3,180,374 | A | 4/1965 | Muller |
| 3,231,149 | A | 1/1966 | Yuza |
| 3,235,128 | A | 2/1966 | Hansen |
| 3,278,063 | A | 10/1966 | Kranzhoff |
| 3,353,718 | A | 11/1967 | McLay |
| 3,356,093 | A | 12/1967 | Monahon |
| 3,392,859 | A | 7/1968 | Fischer |
| 3,412,910 | A | 11/1968 | Hahn |
| 3,448,896 | A | 6/1969 | Kobayashi et al. |
| 3,648,903 | A | 3/1972 | Marchant |
| 3,659,749 | A | 5/1972 | Schwartz |
| 3,662,753 | A | 5/1972 | Tassell |
| 3,669,323 | A | 6/1972 | Harker et al. |
| 3,699,961 | A | 10/1972 | Szpur |
| 3,756,729 | A | 9/1973 | Tufts |
| 3,811,591 | A | 5/1974 | Novitch |
| 3,820,689 | A | 6/1974 | Cocita |
| 3,838,689 | A | 10/1974 | Cohen |
| 3,921,333 | A | 11/1975 | Clendinning et al. |
| 3,963,814 | A | 6/1976 | Cospen et al. |
| 3,987,938 | A | 10/1976 | Cooprider et al. |
| 3,993,069 | A | 11/1976 | Buckles et al. |
| 4,002,516 | A | 1/1977 | Gaborieau et al. |
| 4,015,752 | A | 4/1977 | Meuresch et al. |
| 4,023,607 | A | 5/1977 | Jensen et al. |
| 4,048,255 | A | 9/1977 | Hillier et al. |
| 4,050,459 | A | 9/1977 | Sanchez |
| 4,078,705 | A | 3/1978 | Butcher |
| 4,099,651 | A | 7/1978 | Von Winckelmann |
| 4,102,476 | A | 7/1978 | Loeffler |
| 4,128,349 | A | 12/1978 | Del Bon |
| 4,141,474 | A | 2/1979 | Nilson |
| 4,168,020 | A | 9/1979 | Benson |
| 4,185,628 | A | 1/1980 | Kopfer |
| 4,189,065 | A | 2/1980 | Herold |
| 4,216,236 | A | 8/1980 | Mueller et al. |
| 4,233,262 | A | 11/1980 | Curto |
| 4,239,132 | A | 12/1980 | Mueller et al. |
| 4,240,465 | A | 12/1980 | Rader |
| 4,256,242 | A | 3/1981 | Christine |
| 4,264,018 | A | 4/1981 | Warren |
| 4,346,708 | A | 8/1982 | LeVeen et al. |
| 4,349,133 | A | 9/1982 | Christine |
| 4,366,912 | A | 1/1983 | Matukura et al. |
| 4,367,739 | A | 1/1983 | LeVeen et al. |
| 4,390,111 | A | 6/1983 | Robbins et al. |
| 4,420,100 | A | 12/1983 | Mueller |
| 4,425,366 | A | 1/1984 | Sozzie et al. |
| 4,425,698 | A | 1/1984 | Petrie |
| 4,444,330 | A | 4/1984 | Kasai et al. |
| 4,458,830 | A | 7/1984 | Werding |
| 4,475,905 | A | 10/1984 | Himmelstrup |
| 4,479,578 | A | 10/1984 | Brignola et al. |
| 4,479,989 | A | 10/1984 | Mahal |
| 4,482,585 | A | 11/1984 | Ohodaira et al. |
| 4,493,348 | A | 1/1985 | Lemmons |
| 4,499,148 | A | 2/1985 | Goodale et al. |
| 4,501,781 | A | 2/1985 | Kushida et al. |
| 4,513,891 | A | 4/1985 | Hain et al. |
| 4,526,294 | A | 7/1985 | Hirschmann et al. |
| 4,561,571 | A | 12/1985 | Chen |
| 4,578,295 | A | 3/1986 | Jabarin |
| 4,579,757 | A | 4/1986 | Su et al. |
| 4,603,066 | A | 7/1986 | Jabarin |
| 4,607,764 | A | 8/1986 | Christine |
| 4,624,594 | A | 11/1986 | Sasaki et al. |
| 4,636,412 | A | 1/1987 | Field |
| 4,643,723 | A | 2/1987 | Smit |
| 4,660,737 | A | 4/1987 | Green et al. |
| 4,699,300 | A | 10/1987 | Blake |
| 4,700,838 | A | 10/1987 | Falciani et al. |
| 4,704,510 | A | 11/1987 | Matsui |
| 4,722,459 | A | 2/1988 | Goncalves |
| 4,737,148 | A | 4/1988 | Blake |
| 4,739,906 | A | 4/1988 | LoTurco |
| 4,776,495 | A | 10/1988 | Vignot |
| 4,776,717 | A | 10/1988 | Iizuka et al. |
| 4,784,652 | A | 11/1988 | Wikström |
| 4,815,619 | A | 3/1989 | Turner et al. |
| 4,817,830 | A | 4/1989 | Yavorsky |
| 4,823,990 | A | 4/1989 | Roggenburg et al. |
| 4,834,152 | A | 5/1989 | Howson et al. |
| 4,842,165 | A | 6/1989 | Van Coney |
| 4,854,481 | A | 8/1989 | Bohl et al. |
| 4,854,483 | A | 8/1989 | Haggart |
| 4,854,486 | A | 8/1989 | Daley et al. |
| 4,859,513 | A | 8/1989 | Gibbons et al. |
| 4,865,591 | A | 9/1989 | Sams |
| 4,880,675 | A | 11/1989 | Mehta |
| 4,895,279 | A | 1/1990 | Schultz |
| 4,903,741 | A | 2/1990 | Ibanez |
| 4,910,147 | A | 3/1990 | Bacehowski et al. |
| 4,910,435 | A | 3/1990 | Wakalopulos |
| 4,921,733 | A | 5/1990 | Gibbons et al. |
| 4,923,480 | A | 5/1990 | Monestere |
| 4,936,833 | A | 6/1990 | Sams |
| 4,949,877 | A | 8/1990 | Hanna et al. |
| 4,962,868 | A | 10/1990 | Borchard |
| 4,973,318 | A | 11/1990 | Holm et al. |
| 4,978,036 | A | 12/1990 | Burd |
| 4,981,479 | A | 1/1991 | Py |
| 5,009,654 | A | 4/1991 | Minshall et al. |
| 5,031,675 | A | 7/1991 | Lindgren |
| 5,033,647 | A | 7/1991 | Smith et al. |
| 5,074,440 | A | 12/1991 | Clements et al. |
| 5,083,416 | A | 1/1992 | Schneider et al. |
| 5,088,995 | A | 2/1992 | Packard et al. |
| 5,099,885 | A | 3/1992 | Nilsson |
| 5,102,705 | A | 4/1992 | Yammoto et al. |
| 5,108,007 | A | 4/1992 | Smith et al. |
| 5,129,212 | A | 7/1992 | Duffey et al. |
| 5,143,236 | A | 9/1992 | Gueret |
| 5,145,083 | A | 9/1992 | Takahashi |
| 5,176,510 | A | 1/1993 | Nilsson |
| 5,178,300 | A | 1/1993 | Haviv et al. |
| 5,197,638 | A | 3/1993 | Wood |
| 5,226,568 | A | 7/1993 | Newton et al. |
| 5,226,895 | A | 7/1993 | Harris |
| 5,238,153 | A | 8/1993 | Castillo et al. |
| 5,244,465 | A | 9/1993 | Michel |
| 5,253,785 | A | 10/1993 | Haber et al. |
| 5,257,696 | A | 11/1993 | Greene |
| 5,263,946 | A | 11/1993 | Klug |
| 5,267,986 | A | 12/1993 | Py |
| 5,271,513 | A | 12/1993 | Crosnier et al. |
| 5,277,342 | A | 1/1994 | Dickau et al. |
| 5,290,260 | A | 3/1994 | Stines |
| 5,318,204 | A | 6/1994 | Davis et al. |

5,320,256 A 6/1994 Wood
5,320,845 A 6/1994 Py
5,332,121 A 7/1994 Schmidt et al.
5,339,972 A 8/1994 Crosnier et al.
5,360,145 A 11/1994 Gueret
5,366,108 A 11/1994 Darling
5,401,259 A 3/1995 Py
5,409,142 A 4/1995 Wenmaekers et al.
5,409,146 A 4/1995 Hazard et al.
5,414,267 A 5/1995 Wakalopulos
5,416,303 A 5/1995 Grooms et al.
5,419,465 A 5/1995 Schroeder
5,425,465 A 6/1995 Healy
5,429,254 A 7/1995 Christine
5,452,826 A 9/1995 Stern
5,453,096 A 9/1995 Lataix
5,454,488 A 10/1995 Geier
5,484,566 A 1/1996 Gabbard
5,489,026 A 2/1996 D'Aloia
5,489,027 A 2/1996 Goerigk
RE35,187 E 3/1996 Gortz
5,496,302 A 3/1996 Minshall et al.
5,497,910 A 3/1996 Meadows et al.
5,499,758 A 3/1996 McCann et al.
RE35,203 E 4/1996 Wakalopulos
D368,774 S 4/1996 Py
5,545,147 A 8/1996 Harris
5,556,678 A 9/1996 Jupin et al.
D374,719 S 10/1996 Py
5,562,960 A 10/1996 Sugiura et al.
5,564,596 A 10/1996 Meadows et al.
5,565,160 A 10/1996 Makuuchi et al.
5,582,330 A 12/1996 Iba
5,582,598 A 12/1996 Chanoch
5,591,136 A 1/1997 Gabriel
5,609,273 A 3/1997 Firestone et al.
5,612,588 A 3/1997 Wakalopulos
5,613,957 A 3/1997 Py
5,615,795 A 4/1997 Tipps
5,617,976 A 4/1997 Gueret
5,630,800 A 5/1997 Blank et al.
5,636,930 A 6/1997 Holloway
5,641,004 A 6/1997 Py
5,664,704 A 9/1997 Meadows et al.
5,676,267 A 10/1997 Slat et al.
5,685,869 A 11/1997 Py
5,687,882 A 11/1997 Mueller
5,692,651 A 12/1997 Fuchs
5,697,532 A 12/1997 Wilde et al.
5,702,019 A 12/1997 Grimard
5,718,334 A 2/1998 Demel
5,727,892 A 3/1998 Baudin
5,728,075 A 3/1998 Levander
5,730,322 A 3/1998 Iba et al.
5,738,067 A 4/1998 Landwehr et al.
5,743,441 A 4/1998 Baudin et al.
5,743,889 A 4/1998 Sams
5,746,728 A 5/1998 Py
5,759,218 A 6/1998 Martin et al.
5,772,079 A 6/1998 Gueret
5,772,347 A 6/1998 Gueret
5,780,130 A 7/1998 Hansen et al.
5,799,837 A 9/1998 Firestone et al.
5,803,311 A 9/1998 Fuchs
5,804,236 A 9/1998 Frisk
5,816,772 A 10/1998 Py
5,823,397 A 10/1998 Gil
5,836,484 A 11/1998 Gerber
5,855,302 A 1/1999 Fisscher
5,857,595 A 1/1999 Nilson
5,860,755 A 1/1999 Bunk
5,875,931 A 3/1999 Py
5,876,372 A 3/1999 Grabenkort et al.
5,879,095 A 3/1999 Gueret
5,879,336 A 3/1999 Brinon
5,899,624 A 5/1999 Thompson
5,909,032 A 6/1999 Wakalopulos
5,921,989 A 7/1999 Deacon et al.
5,927,550 A 7/1999 Mack et al.
5,931,386 A 8/1999 Jouillat
5,934,500 A 8/1999 Cogger et al.
5,944,702 A 8/1999 Py
5,971,181 A 10/1999 Niedospial, Jr. et al.
5,971,224 A 10/1999 Garibaldi
RE36,410 E 11/1999 Meshberg
5,983,905 A 11/1999 Patching
5,996,845 A 12/1999 Chan
6,003,733 A 12/1999 Wheeler
6,004,298 A 12/1999 Levander
6,024,252 A 2/2000 Clyde
6,032,101 A 2/2000 Freedman et al.
6,033,384 A 3/2000 Py
6,050,435 A 4/2000 Bush et al.
6,050,444 A 4/2000 Sugg
6,053,370 A 4/2000 Ludbrook et al.
6,053,893 A 4/2000 Bucher
6,062,430 A 5/2000 Fuchs
6,062,437 A 5/2000 Mascitelli
6,083,201 A 7/2000 Skinkle
6,083,450 A 7/2000 Safian
6,092,695 A 7/2000 Loeffler
6,140,657 A 10/2000 Wakalopulos et al.
6,145,707 A 11/2000 Baudin
6,149,957 A 11/2000 Mandralis et al.
6,168,037 B1 1/2001 Grimard
6,170,705 B1 1/2001 Schneider et al.
6,170,715 B1 1/2001 Evans
RE37,047 E 2/2001 Py
6,182,698 B1 2/2001 Barak
6,186,686 B1 2/2001 Neuner et al.
6,193,698 B1 2/2001 Kirchhofer et al.
6,200,047 B1 3/2001 Holloway
6,202,901 B1 3/2001 Gerber et al.
6,216,916 B1 4/2001 Maddox et al.
6,234,363 B1 5/2001 Stradella
6,254,579 B1 7/2001 Cogger et al.
6,267,768 B1 7/2001 Deacon et al.
6,280,421 B1 8/2001 Kirchhofer et al.
6,283,976 B1 9/2001 Portney
6,290,679 B1 9/2001 Hostettler et al.
6,301,767 B1 10/2001 Granger et al.
6,306,423 B1 10/2001 Donovan et al.
6,312,708 B1 11/2001 Donovan
6,325,253 B1 12/2001 Robinson
6,338,442 B1 1/2002 De Laforcade
6,343,713 B1 2/2002 Abplanalp
6,351,924 B1 3/2002 Gustafsson et al.
6,357,945 B1 3/2002 Losier et al.
6,364,864 B1 4/2002 Mohiuddin et al.
6,371,129 B1 4/2002 Le Bras-Brown et al.
6,382,441 B1 5/2002 Carano
6,383,167 B2 5/2002 Kirchhofer et al.
6,383,509 B1 5/2002 Donovan et al.
6,386,395 B1 5/2002 Lunghetti
6,419,412 B1 7/2002 Ostrowski et al.
6,428,545 B2 8/2002 Portney
6,446,844 B1 9/2002 Gross
6,450,994 B1 9/2002 Boyles et al.
6,455,093 B1 9/2002 Furrer et al.
6,471,095 B1 10/2002 Cann
6,485,470 B2 11/2002 Hostettler et al.
6,491,189 B2 12/2002 Friedman
6,502,725 B1 1/2003 Alexander
6,524,287 B1 2/2003 Cogger
6,533,482 B1 3/2003 Byun
6,547,108 B2 4/2003 Johanson

| | | | |
|---|---|---|---|
| 6,561,383 | B1 | 5/2003 | Reddy et al. |
| 6,581,805 | B2 | 6/2003 | Conboy et al. |
| 6,592,918 | B2 | 7/2003 | Kaser |
| 6,592,922 | B2 | 7/2003 | Furrer et al. |
| 6,604,561 | B2 | 8/2003 | Py |
| 6,662,977 | B2 | 12/2003 | Gerber et al. |
| 6,695,173 | B1 | 2/2004 | Fontana |
| 6,698,628 | B2 | 3/2004 | Mascitelli |
| 6,726,389 | B1 | 4/2004 | Lee |
| 6,742,680 | B2 | 6/2004 | Friedman |
| 6,755,327 | B1 | 6/2004 | Hazard et al. |
| D493,366 | S | 7/2004 | Rackwitz |
| 6,761,286 | B2 | 7/2004 | Py et al. |
| 6,769,627 | B2 | 8/2004 | Carhuff et al. |
| 6,802,436 | B2 | 10/2004 | Drennow et al. |
| 6,883,222 | B2 | 4/2005 | Landau |
| 6,892,906 | B2 | 5/2005 | Py et al. |
| 6,971,553 | B2 | 12/2005 | Brennan et al. |
| 6,997,219 | B2 | 2/2006 | Py et al. |
| 7,278,553 | B2 | 10/2007 | Py et al. |
| 7,322,491 | B2 | 1/2008 | Py et al. |
| 7,328,729 | B2 | 2/2008 | Py et al. |
| 2001/0009990 | A1 | 7/2001 | Hostettler et al. |
| 2001/0027827 | A1 | 10/2001 | Jeannin et al. |
| 2001/0041872 | A1 | 11/2001 | Paul, Jr. |
| 2002/0006353 | A1 | 1/2002 | Bilstad et al. |
| 2002/0010995 | A1 | 1/2002 | Thibault et al. |
| 2002/0017294 | A1 | 2/2002 | Py |
| 2002/0018731 | A1 | 2/2002 | Bilstad et al. |
| 2002/0029022 | A1 | 3/2002 | Naritomi et al. |
| 2002/0050301 | A1 | 5/2002 | Jeannin et al. |
| 2002/0071708 | A1 | 6/2002 | Fontanet et al. |
| 2002/0074362 | A1 | 6/2002 | Py et al. |
| 2002/0121527 | A1 | 9/2002 | Good |
| 2002/0124907 | A1 | 9/2002 | Crossdale et al. |
| 2002/0131902 | A1 | 9/2002 | Levy |
| 2002/0172615 | A1 | 11/2002 | Woodworth et al. |
| 2003/0012858 | A1 | 1/2003 | Furrer et al. |
| 2003/0082070 | A1 | 5/2003 | Liberto et al. |
| 2003/0089743 | A1 | 5/2003 | Py et al. |
| 2003/0156973 | A1 | 8/2003 | Bilstad et al. |
| 2004/0011820 | A1 | 1/2004 | Abergel et al. |
| 2004/0112925 | A1 | 6/2004 | Py et al. |
| 2004/0118291 | A1 | 6/2004 | Carhuff et al. |
| 2004/0194811 | A1 | 10/2004 | Carhuff et al. |
| 2005/0029307 | A1 | 2/2005 | Py et al. |
| 2005/0072480 | A1 | 4/2005 | Brandes |
| 2005/0089358 | A1 | 4/2005 | Py et al. |
| 2005/0165368 | A1 | 7/2005 | Py et al. |
| 2006/0169722 | A1 | 8/2006 | Py et al. |
| 2008/0121668 | A1 | 5/2008 | Py |

FOREIGN PATENT DOCUMENTS

| | | |
|---|---|---|
| EP | 0 172 711 | 2/1986 |
| EP | 0 616 141 | 9/1994 |
| EP | 0 733 559 | 9/1996 |
| EP | 0 743 263 | 11/1996 |
| EP | 0802827 B1 | 8/1998 |
| EP | 0649795 B1 | 6/1999 |
| EP | 0673852 B1 | 2/2000 |
| FR | 2 709 733 | 3/1995 |
| GB | 984149 | 2/1965 |
| GB | 2 364 700 | 2/2002 |
| JP | S59-10986 | 4/1984 |
| JP | H2-21078 | 6/1990 |
| JP | 06-239379 | 7/1994 |
| JP | 10-156269 | 6/1998 |
| JP | 2002-347812 | 4/2002 |
| JP | 05-016950 | 1/2003 |
| WO | WO 93/16955 | 9/1993 |
| WO | WO 99/32185 | 1/1999 |
| WO | WO 99/41158 | 8/1999 |
| WO | WO 00/29192 | 5/2000 |
| WO | WO 02/40122 | 5/2002 |

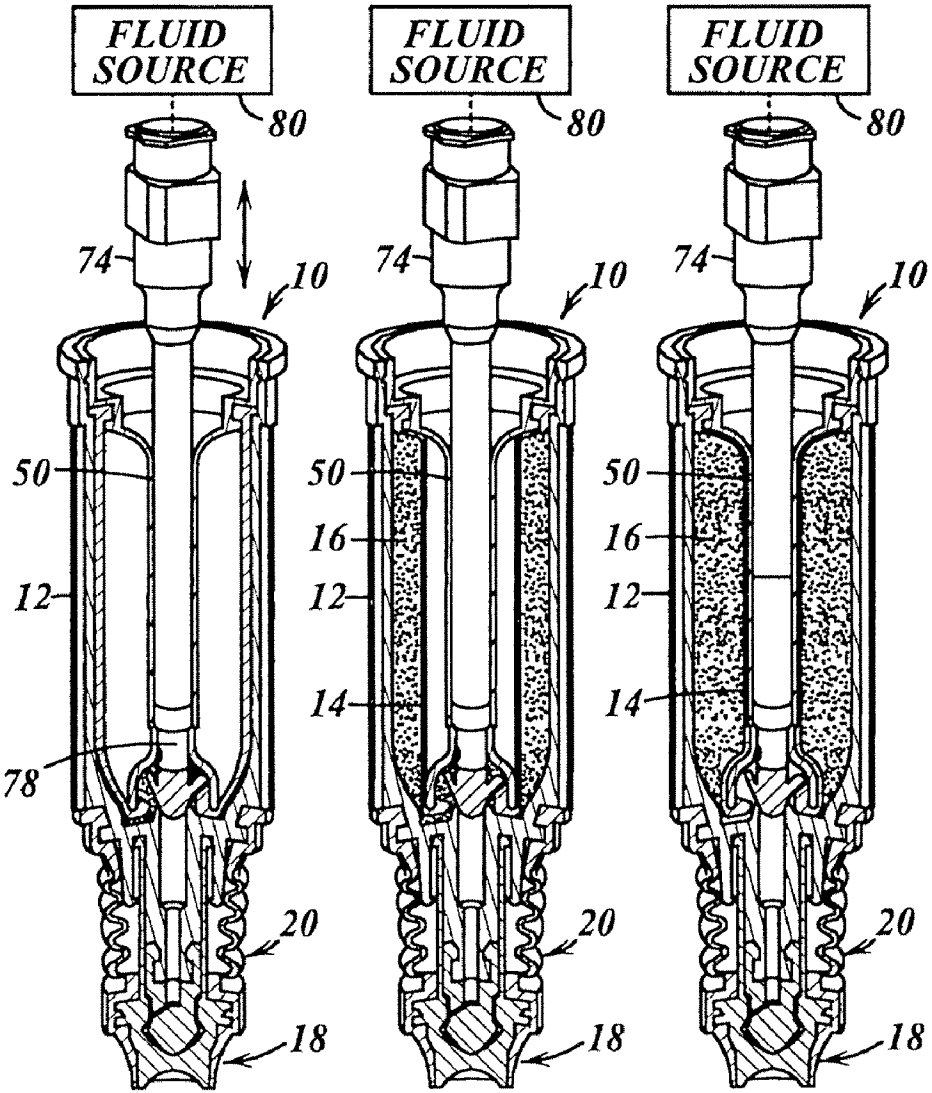
FIG. 5A
FIG. 5B
FIG. 5C
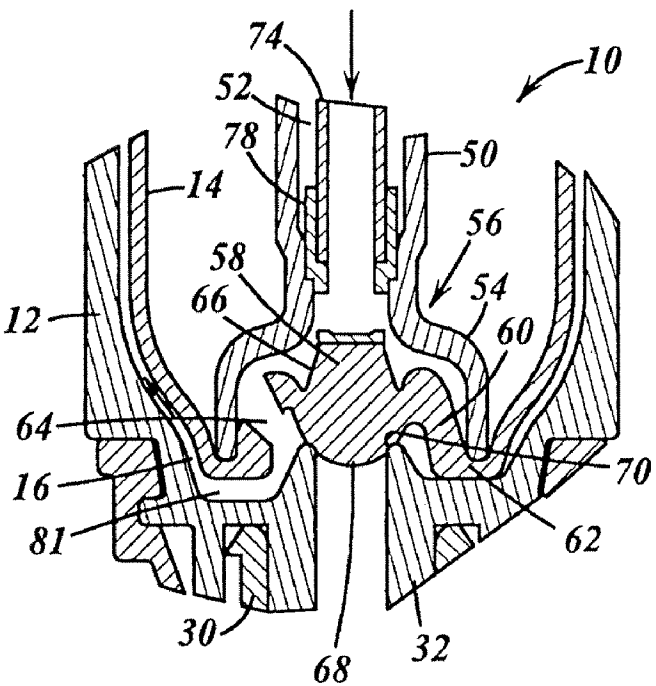
FIG. 5D

DISPENSER AND APPARATUS AND METHOD OF FILLING A DISPENSER

CROSS-REFERENCE TO RELATED PRIORITY APPLICATIONS

This application is a continuation of U.S. application Ser. No. 11/349,873, entitled "Dispenser and Apparatus and Method for Filling a Dispenser," filed Feb. 8, 2006 now U.S. Pat. No. 7,328,729, which is a continuation of similarly-titled U.S. application Ser. No. 10/843,902, filed May 12, 2004 now U.S. Pat. No. 6,997,219, which claims priority to similarly-titled U.S. Application Ser. No. 60/469,677, filed May 12, 2003; and to similarly-titled U.S. Application Ser. No. 60/471,592, filed May 19, 2003, and to U.S. Application Ser. No. 60/488,355, filed Jul. 17, 2003, titled "Piston-Type Dispenser with One-Way Valve for Storing and Dispensing Metered Amounts of Substances, and Pivoting Cover for Covering Dispensing Portion Thereof", and to U.S. Application Ser. No. 60/539,814, filed Jan. 27, 2004, entitled "Piston-Type Dispenser with One-Way Valve for Storing and Dispensing Metered Amounts of Substances"; the disclosures of which are hereby expressly incorporated by reference as part of the present disclosure.

FIELD OF THE INVENTION

The present invention relates to dispensers for containing and dispensing fluids and other substances, such as medicaments, and more particularly, to dispensers for holding multiple doses of fluids and other substances, and to apparatus and methods for filling such dispensers with fluids and other substances.

BACKGROUND INFORMATION

A typical medicament dispenser includes a body defining a storage chamber, a fill opening in fluid communication with the body, and a stopper or cap for sealing the fill opening after filling the storage chamber to hermetically seal the medicament within the dispenser. In order to fill such prior art dispensers with a sterile fluid or other substance, such as a medicament, it is typically necessary to sterilize the unassembled components of the dispenser, such as by autoclaving the components and/or exposing the components to gamma radiation. The sterilized components then must be filled and assembled in an aseptic isolator of a sterile filling machine. In some cases, the sterilized components are contained within multiple sealed bags or other sterile enclosures for transportation to the sterile filling machine. In other cases, the sterilization equipment is located within the isolator of the sterile filling machine. In the isolator, the storage chamber is filled with the fluid or other substance, and then the sterilized stopper is assembled to the dispenser to plug the fill opening and hermetically seal the fluid or other substance in the dispenser.

One of the drawbacks of such prior art dispensers, and processes and equipment for filling such dispensers, is that the filling process is time consuming, and the processes and equipment are expensive. Further, the relatively complex nature of the filling processes and equipment can lead to more defectively filled dispensers than otherwise desired.

The present inventor has recognized the advantages of sterilizing a sealed, empty dispenser, and then filling the sterilized, sealed, empty dispenser under a laminar flow to maintain aseptic conditions during filling. For example, U.S. Pat. No. 6,604,561, entitled "Medicament Vial Having a Heat-Sealable Cap, and Apparatus and Method for Filling the Vial", which is assigned to the Assignee of the present invention and is hereby expressly incorporated by reference as part of the present disclosure, discloses a vial including a resealable stopper. The resealable stopper is first sealed to the empty vial, and then the empty vial/stopper assembly is sterilized, such as by applying gamma radiation thereto. The sterilized, sealed, empty vial/stopper assembly is then filled by piercing the resealable stopper with a needle, and introducing the fluid or other substance through the needle and into the chamber of the vial. Then, the needle is withdrawn, and laser radiation is transmitted onto the penetrated region of the stopper to seal the needle hole and hermetically seal the sterile fluid or other substance within the vial/stopper assembly.

Although this resealable stopper, apparatus and method overcome many of the drawbacks and disadvantages associated with prior art equipment and processes for sterile filling, in certain instances it may not be desirable to employ a resealable stopper, a needle for piercing the stopper, and/or a laser for resealing the penetrated region of a stopper.

Accordingly, it is an object of the present invention to overcome one or more of the above-described drawbacks and/or disadvantages, and to provide a dispenser, and an apparatus and method for filling the dispenser, wherein the dispenser may be sealed and sterilized in an empty condition, and the sterilized, sealed, empty dispenser may be filled without disassembling the dispenser to hermetically seal the sterilized fluid or other substance within the dispenser.

BRIEF DESCRIPTION OF THE DRAWINGS

FIG. 5A is a perspective, cross-sectional view of the dispenser of FIG. 1 showing a filling member received within the fill tube of the dispenser and engaging the flexible valve member to fully open the valve member and, in turn, introduce a fluid or other substance, such as a medicament, through the open valve and into the storage chamber.

FIG. 5B is a perspective, cross-sectional view of the dispenser of FIG. 5A showing the storage chamber about half filled with a fluid or other substance, and showing the flexible bladder in a correspondingly partially collapsed condition.

FIG. 5C is a perspective, cross-sectional view of the dispenser of FIG. 5A showing the storage chamber filled with a fluid or other substance, and showing the flexible bladder in a correspondingly fully collapsed condition.

FIG. 5D is a partial, cross-sectional view of the dispenser of FIG. 1 showing the filling member engaging the flexible valve member in the fully open position and the flow path of a fluid or other substance through the open filling valve, through one or more grooves formed at the base of the flexible bladder between the bladder and vial base, and into the storage chamber to fill the storage chamber;

SUMMARY OF THE INVENTION

Figure 2:
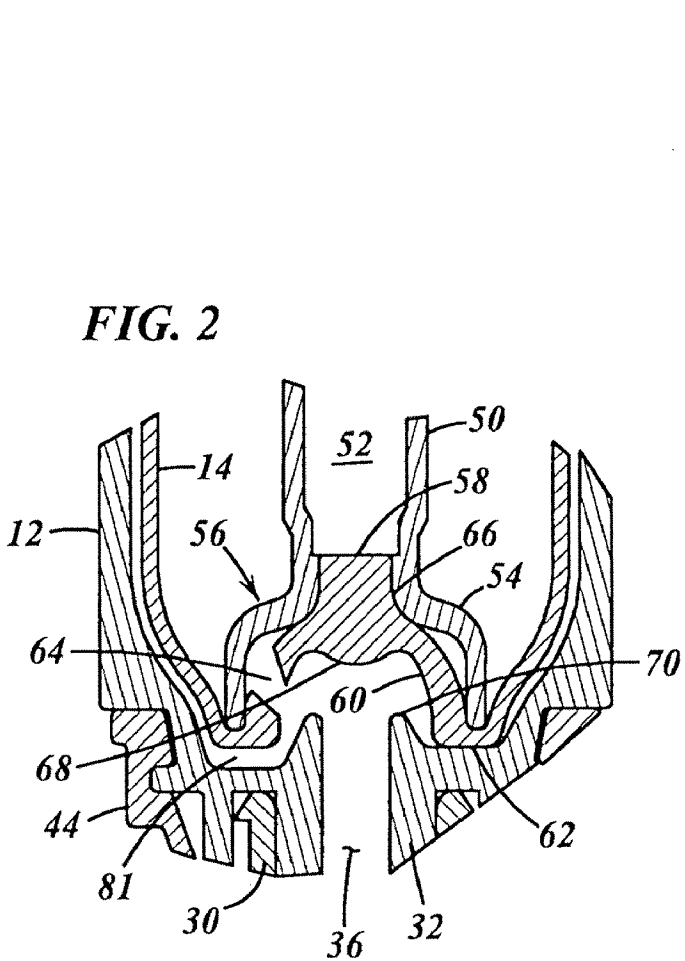
FIG. 2 is a partial, cross-sectional view of the dispenser of FIG. 1 showing the filling valve for evacuating the interior of the dispenser and for introducing a fluid or other substance into the storage chamber of the dispenser to fill the dispenser.

The present invention is directed to a dispenser comprising a body; a variable-volume storage chamber formed within the body; and a filling valve coupled in fluid communication with the storage chamber. The filling valve defines (1) a normally closed, fluid-tight position hermetically sealing the storage chamber from the ambient atmosphere, and (2) an open position allowing the passage of fluid through the valve to withdraw fluid therethrough to evacuate the storage chamber and/or to introduce fluid therethrough to fill the storage chamber. A pump is coupled in fluid communication with the storage chamber for pumping fluid out of the storage chamber; and a dispensing valve is coupled in fluid communication with the pump and defines (1) a normally closed, fluid-tight position preventing the passage of fluid therethrough, and (2) an open position for dispensing pumped fluid therethrough.

In a currently preferred embodiment of the present invention, the filling valve includes a flexible valve member, and a valve seat engagable with the flexible valve member. The flexible valve member is movable into the closed position in engagement with the valve seat to form a fluid-tight seal therebetween, and is movable into the open position spaced away from the valve seat to form a valve opening for the passage of fluid therebetween. The filling valve also preferably includes a spring that urges the valve member toward the closed position. In a currently preferred embodiment, the spring is formed integral with the flexible valve member. Also in a currently preferred embodiment, the spring is approximately dome-shaped and applies both radially directed and axially directed forces to the flexible valve member to urge the valve member toward the closed position. At least one flow aperture is formed through the spring and is coupled in fluid communication between an inlet to the filling valve and the storage chamber.

Also in a currently preferred embodiment of the present invention, the filling valve includes a first valve seat and a first sealing surface movable relative to the first valve seat between the closed and open positions. The first sealing surface is engagable with the first valve seat in the closed position to form a fluid-tight seal therebetween, and is spaced away from the first valve seat in the open position to form a valve opening for the passage of fluid therethrough.

Also in a currently preferred embodiment of the present invention, the filling valve includes a second sealing surface and a second valve seat formed between the storage chamber and the dispensing valve. The second sealing surface is movable between an open position spaced away from the second valve seat for allowing the flow of fluid therethrough, and a closed position engagable with the second valve seat and forming a fluid-tight seal therebetween. Preferably, the filling valve includes a flexible valve member defining the first sealing surface on one side thereof and the second sealing surface on another side thereof.

The present invention also is directed to an apparatus for sterile filling a dispenser. In a currently preferred embodiment of the present invention, the dispenser includes a fill tube coupled in fluid communication with the filling valve. The apparatus for sterile filling includes at least one probe or filling member connectable in fluid communication with the filling valve to open the valve and withdraw fluid from the dispenser through the filling valve to evacuate the dispenser, and/or to introduce fluid from the probe and into the storage chamber of the dispenser.

The sterile filling apparatus preferably further comprises a vacuum source that is connectable in fluid communication with the probe for drawing a vacuum through the probe and, in turn, through a dispenser coupled in fluid communication with the probe, or that is otherwise connectable in fluid communication with the interiors of the dispensers, such as through the dispensing valves. The sterile filling apparatus also comprises a fluid source coupled in fluid communication with at least one probe for introducing fluid therethrough and into the storage chamber of a dispenser coupled in fluid communication with the probe. The sterile filling apparatus preferably further comprises a laminar flow source for introducing a substantially laminar flow of fluid over the at least one probe and dispenser coupled in fluid communication therewith.

The present invention also is directed to a method for filling a dispenser, wherein the dispenser includes a body; a variable-volume storage chamber formed within the body; a filling valve coupled in fluid communication with the storage chamber and defining (1) a normally closed, fluid-tight position hermetically sealing the storage chamber from the ambient atmosphere, and (2) an open position allowing the passage of fluid through the valve to withdraw fluid therethrough to evacuate the storage chamber, and/or to introduce fluid therethrough to fill the storage chamber; a pump coupled in fluid communication with the storage chamber for pumping fluid out of the storage chamber; and a dispensing valve coupled in fluid communication with the pump and defining (1) a normally closed, fluid-tight position preventing the passage of fluid therethrough, and (2) an open position for dispensing pumped fluid therethrough. The method comprises the following steps:

(i) providing a filling probe or member coupled in fluid communication with a fluid source;

(ii) connecting the filling probe in fluid communication with the filling valve and, in turn, moving the filling valve from the closed to the open position;

(iii) introducing a fluid from the probe through the open filling valve and into the storage chamber; and (iv) withdrawing the probe from the filling valve and, in turn, moving the filling valve from the open to the closed position and hermetically sealing the fluid within the storage chamber.

In a currently preferred embodiment of the present invention, the method further comprises the step of evacuating the interior of the dispenser prior to filling. In one such embodiment of the present invention, the method further comprises the steps of.

connecting a probe coupled in fluid communication with a vacuum source in fluid communication with the filling valve and, in turn, moving the filling valve from the closed to the open position;

drawing a vacuum through the probe and, in turn, evacuating the storage chamber of the dispenser;

providing a substantially laminar flow of fluid over the probe and dispenser coupled in fluid communication therewith; and sealing the pump and dispensing valve from the storage chamber during filling of the storage chamber to prevent a flow of fluid through the dispensing valve during filling of the storage chamber.

In another embodiment of the present invention, the interior of the dispenser is evacuated by connecting a vacuum source in fluid communication with the interior of the dispenser through the dispensing valve. Then, after evacuating the dispenser, filling the variable-volume storage chamber through the filling valve.

One advantage of the present invention is that the dispenser may be assembled, sealed and sterilized empty. Then, the sterilized dispenser may be filled with a sterile fluid or other substance through the filling valve and without disassembling the dispenser.

Other advantages of the present invention will become more readily apparent in view of the following detailed description of the currently preferred embodiments and accompanying drawings.

DETAILED DESCRIPTION OF THE PREFERRED EMBODIMENTS

Figure 1:
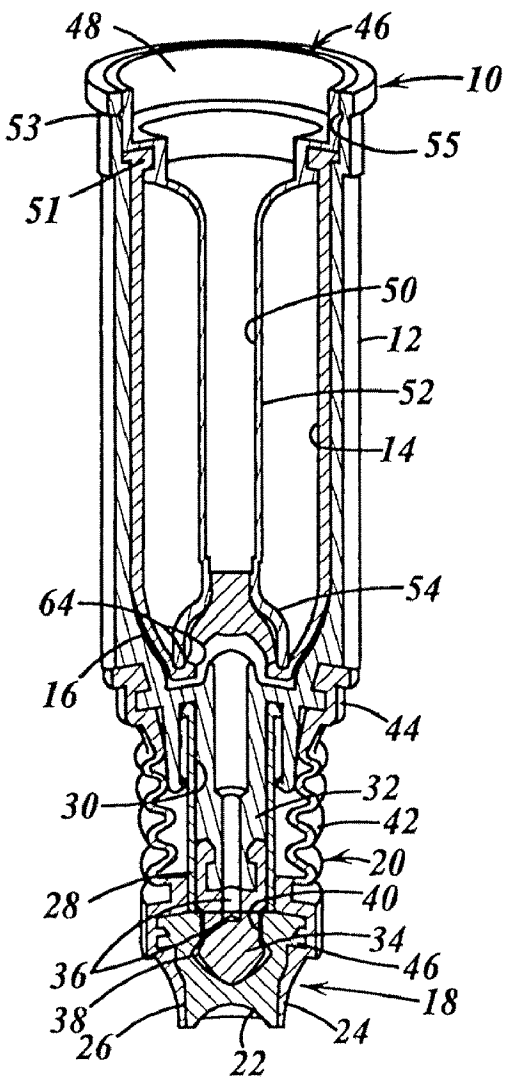
FIG. 1 is a perspective cross-sectional view of a dispenser embodying the present invention.

In FIG. 1, a dispenser embodying the present invention is indicated generally by the reference numeral 10. The dispenser 10 comprises a rigid vial or body 12, a flexible bladder 14 mounted within the rigid vial 12, and a variable-volume storage chamber 16 formed between the vial and bladder for receiving therein a fluid or other substance, such as a medicament. The dispenser 10 further comprises a dispensing nozzle 18 and a pump 20 coupled in fluid communication between the dispensing nozzle 18 and the storage chamber 16 for pumping metered doses of the fluid or other substance from the storage chamber 16 through the dispensing nozzle.

The dispensing nozzle 18 includes a relatively rigid valve seat 22 and a flexible valve cover 24 mounted over the valve seat and defining an axially elongated, annular seam 26 therebetween. As described further below, the pump 20 forces a metered dose of fluid or other substance at sufficient pressure to open the valve (the "valve opening pressure") and force the fluid through the valve seam 26 and out of the dispenser. The valve cover 24 preferably forms an interference fit with the valve seat 22 to thereby form a fluid-tight seal in the normally closed position and, in turn, maintain the fluid or other substance within the dispenser in a sterile and hermetically sealed condition. Further, as shown typically in FIG. 1, the valve cover 24 defines a substantially tapered cross-sectional shape moving in the axial direction from the interior toward the exterior of the valve. This configuration requires progressively less energy to open each respective annular portion of the valve when moving axially from the interior toward the exterior of the valve. As a result, once the base of the valve is opened, the pressure is sufficient to cause the respective axial segments of the valve cover 24 to progressively open and then close after passage of fluid therethrough when moving in the axial direction to dispense a metered dose. Also, during dispensing of a metered dose, preferably a substantially annular segment of the valve cover 24 substantially always engages the valve seat 22 to maintain the fluid-tight seal across the valve 20 and thereby prevent ingress through the valve of germs, bacteria or other unwanted substances into the storage chamber.

The valve cover 24 and the valve seat 22 may take any of numerous different shapes and/or configurations that are currently known, or that later become known, such as any of the shapes and/or configurations disclosed in the following copending patent applications that are assigned to the Assignee of the present invention and are hereby expressly incorporated by reference as part of the present disclosure: U.S. application Ser. No. 10/640,500, filed Aug. 13, 2003, entitled "Container and Valve Assembly for Storing and Dispensing Substances"; U.S. provisional application Ser. No. 60/528,429, filed Dec. 10, 2003, entitled "Valve Assembly and Tube Kit for Storing and Dispensing Substances"; and U.S. provisional application Ser. No. 60/539,602, filed Jan. 27, 2003, entitled "Tubular Container and One-Way Valve Assembly for Storing and Dispensing Substances".

The pump 20 includes a rigid slide 28 defining therein an axially elongated bore 30. A piston 32 is slidably received within the bore 30 and includes a piston tip 34 on the free end thereof. The piston 32 and tip 34 define a fluid conduit 36 extending therethrough. A dosage chamber 38 is formed between the piston tip 34 and an interior surface of the valve seat 22. The fluid conduit 36 is coupled in fluid communication between the dosage chamber 38 and storage chamber 16 for dispensing fluid from the storage chamber into the dosage chamber upon actuation of the pump.

The slide 28 defines a reduced cross-sectional portion 40 that cooperates with the piston tip 34 to define the volume of the dosage chamber 38 and thus the dosage volume of the dispenser. The axial extent of the reduced portion 40 defines a compression zone within which the fluid or other substance is compressed by the piston and, in turn, forced through the dispensing nozzle 18. On the downward stroke of the piston 32, and prior to the piston tip 34 slidably engaging the reduced portion 40, fluid is permitted to flow both forwardly in front of the piston, and rearwardly back over the sides of the piston tip. Then, when the piston tip 34 slidably engages the reduced portion 40, a fluid-tight seal is formed therebetween, thus trapping a precise volume of fluid within the compression zone and forcing the precise volume of fluid through the valve. The valve seat 24 defines one or more apertures (not shown) extending between the dosage chamber and the seam 26 to allow the fluid to flow therethrough and out of the valve. The valve tip 34 is preferably made of an elastomeric material that is relatively soft in comparison to the slide 28 and reduced portion 40 thereof. For example, the valve tip 34 may be made of a polymeric material, such as the material sold under the trademark Kraton™, or a vulcanized rubber or other polymeric material. As may be recognized by those of ordinary skill in the pertinent art based on the teachings herein, these materials are only exemplary, however, and numerous other materials that are currently or later become known for performing the function of the valve tip equally may be used.

A spring portion or bellows 42 is formed integral with the valve cover 24 and extends between the base of the valve cover and the vial 12. As can be seen, the piston 32 is formed integral with the vial 12 and extends axially therefrom. The spring 42 is fixedly secured at one end to the vial 12 at a first annular flange 44, and is fixedly secured at another end to a second annular flange 46 extending outwardly from the base of the valve seat 22. The pump 20 is actuated by moving at least one of the piston 32 and slide 30 relative to the other to cause the piston tip 34 to move axially within the slide to load the dosage chamber 38 and, in turn, dispense the metered dose of fluid or other substance from the dosage chamber and through the valve.

As may be recognized by those of ordinary skill in the pertinent art based on the teachings herein, the construction of many aspects of the dispenser 10, including aspects of the vial, variable-volume storage chamber, pump and nozzle, may be the same as or similar to that described in any of co-pending U.S. patent application Ser. No. 10/001,745, filed Oct. 23, 2001, entitled "Fluid Dispenser Having A Rigid Vial And Flexible Inner Bladder", similarly titled U.S. patent application Ser. No. 10/691,270, filed Oct. 21, 2003, U.S. Provisional Application Ser. No. 60/519,961, filed Nov. 14, 2003, entitled "Delivery Device And Method Of Delivery", and U.S. Provisional Application Ser. No. 60/539,814, filed Jan. 27, 2004, entitled "Piston-Type Dispenser With One-Way Valve For Storing And Dispensing Metered Amounts Of Substances", each of which is assigned to the Assignee of the present invention, and is hereby expressly incorporated by reference as part of the present disclosure. In addition, the dispenser 10 may be mounted within any of the cartridges and/or housings shown in U.S. Patent Application Ser. No. 60/420,334, filed Oct. 21, 2002, entitled "Dispenser", and/or U.S. Patent Application Ser. No. 60/443,524, filed Jan. 28, 2003, entitled "Dispenser", each of which is assigned to the Assignee of the present invention, and is hereby expressly incorporated by reference as part of the present disclosure.

The dispenser 10 further comprises an end cap 46 including a mounting flange 48 that is received within the open end of the vial 12 and fixedly secured thereto, a filling tube 50 extending axially inwardly from the flange 48 and defining a fluid conduit 52 therein, and a substantially dome-shaped valve seat 54 formed at the other end of the filling tube and engaging the base of the bladder 14. The flexible bladder 14 defines an annular sealing flange 51 that is compressed between the flange 48 of the end cap 46 and the vial 12 to form a fluid-tight seal therebetween. The flange 48 of the cap 46 defines a peripheral lobe 53 that is snap-fit into a corresponding annular recess 55 of the vial to fixedly secure the cap to the vial with the sealing flange 51 of the bladder compressed therebetween.

As shown in FIG. 2, the bladder 14 and dome-shaped valve seat 54 cooperate to form a second or filling valve 56. The filling valve 56 includes a valve member 58 formed integral with the bladder 14, and a substantially dome-shaped spring portion 60 also formed integral with the bladder 14 and extending between the valve member 58 and a base portion 62 of the bladder. At least one valve aperture 64 is formed through the dome-shaped valve spring 60 to permit the flow of fluid and/or other substance therethrough when the filling valve is in the open position. The flexible valve member 58 defines a first sealing surface 66 that sealingly engages the valve seat 54 in the normally-closed position to form a fluid-tight seal therebetween. The spring 60 normally urges the valve member 58 axially upwardly in the Figure to cause the first sealing surface 66 to sealingly engage the valve seat and form a fluid-tight seal therebetween. As described further below, the spring 60 allows the flexible valve member 58 to be moved axially inwardly (or downwardly in the Figure) to, in turn, open the valve and allow the flow of fluid or other substance therethrough. The valve member 58 defines on its interior side a second sealing surface 68, and the vial 12 defines at the inlet to the fluid conduit 36 a corresponding annular valve seat 70. As described further below, in the open position of the filling valve 56, the second sealing surface 68 may be moved into engagement with the valve seat 70 to form a fluid-tight seal therebetween to, in turn, prevent the flow of fluid into the fluid conduit 36 of the piston.

As may be recognized by those of ordinary skill in the pertinent art based on the teachings herein, the spring 60 of the filling valve 56 may take any of numerous different shapes and/or configurations, or may be formed of any of numerous different materials, that are currently, or later become known for performing the function of the spring as described herein. For example, the spring may define a shape other than a dome shape, or may not be formed integral with the bladder or the valve member. Also, the shape and/or material of construction of the spring may be selected to control the spring force applied to the valve member. One advantage of the substantially dome-shaped configuration, however, is that the dome shape imparts lateral (or radial) and axial forces to the flexible valve member 58 to facilitate maintaining a fluid-tight seal throughout the shelf-life and usage of the dispenser 10. The bladder 12 (including the integral valve member 58) is preferably made of an elastomeric material that is relatively soft in comparison to the vial 12 and valve seat 54. For example, the bladder 12 may be made of a polymeric material, such as the material sold under the trademark Kraton™, or a vulcanized rubber or other polymeric material. However, as may be recognized by those of ordinary skill in the pertinent art based on the teachings herein, these materials are only exemplary, and numerous other materials that are currently, or later become known for performing the functions of the bladder and/or valve member equally may be used.

As shown in FIG. 1, when the dispenser is empty, the bladder 14 is fully expanded into engagement with the interior surfaces of the vial 12 such that the variable volume storage chamber 16 is at substantially zero volume. As described in the above-mentioned co-pending patent application, the bladder 14 is preferably formed such that it naturally tends to flex outwardly and create a positive pressure gradient on the fluid or other substance in the storage chamber 16. Also, in this position, the valve member 58 of the filling valve 56 is in the normally closed position to maintain the interior of the dispenser hermetically sealed. In this condition, the empty dispenser may be sterilized prior to filling, such as by applying gamma, e-beam, or another type of radiation thereto. Then, the sealed, empty and sterilized dispenser may be transported to a sterile filling machine or other filling station without risk of contaminating the sterilized interior portions of the dispenser, as described further below.

Figure 3:
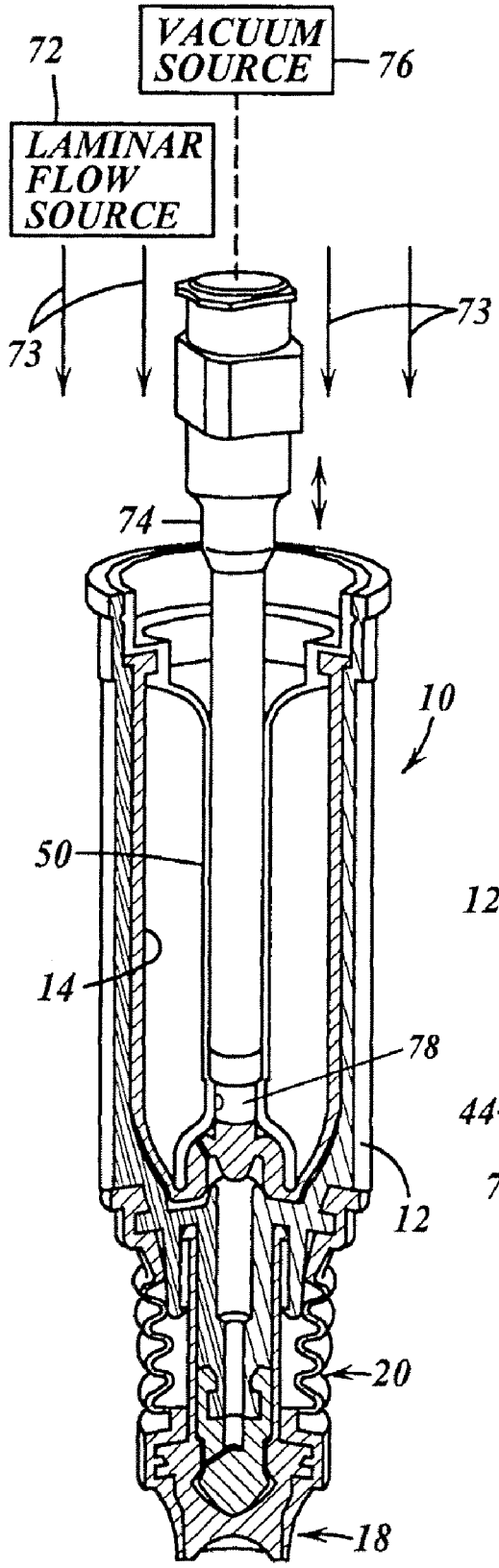
FIG. 3 is a partial, cross-sectional view of the dispenser of FIG. 1 showing a filling/evacuating member received within the fill tube of the dispenser and engaging the flexible valve member of the filling valve for opening the filling valve.
Figure 4:
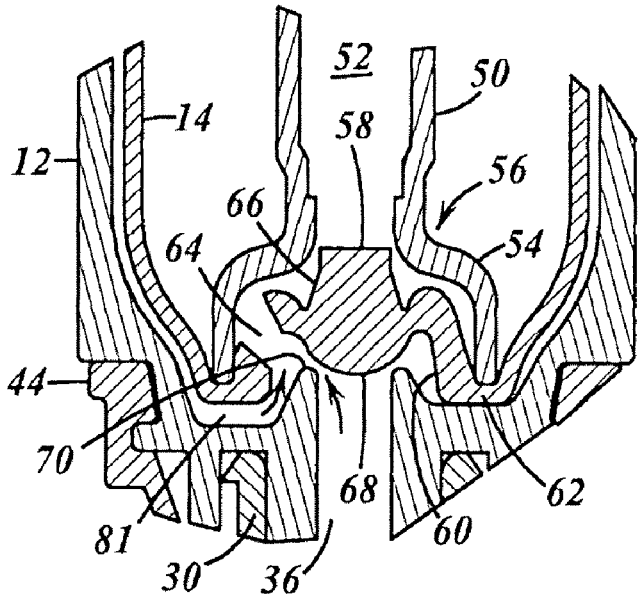
FIG. 4 is a partial, cross-sectional view of the dispenser of FIG. 1 showing the filling valve in an open condition such that the flexible valve member is located in a mid-position for evacuating air or other gases from the interior of the dispenser prior to filling same with a fluid or other substance, such as a medicament.

Turning to FIG. 3, the dispenser 10 is filled in a sterile filling machine comprising a sterile enclosure (not shown) of a type known to those of ordinary skill in the pertinent art that includes a laminar flow source 72 for directing a substantially laminar flow of sterilized air or other gas(es) 73 over the dispenser 10 during filling to maintain aseptic conditions. The sterile filling machine further includes an evacuating/filling member 74 that is connected in fluid communication with a vacuum source 76 for drawing a vacuum through the filling member and, in turn, evacuating the interior of the dispenser. As indicated by the arrows in FIG. 3, the filling member 74 is movable axially into and out of the fill tube 50 of the dispenser to open the filling valve 56 and evacuate the interior of the dispenser. In this mode, and as shown in FIGS. 3 and 4, the tip 78 of the filling member 74 depresses the flexible valve member 58 only about one-half its full extent of axial mobility. As can be seen best in FIG. 4, in this position the sealing surfaces 66 and 68 of the valve member 58 are spaced away from their corresponding valve seats 54 and 70, respectively, to thereby define valve openings therebetween. The vacuum source 76 is actuated to draw air or other gases out of the interior chambers to evacuate the dispenser. After a vacuum is created inside the dispenser, the filling member 74 is moved out of the fill tube 50, and the spring 60 drives the valve member 58 into the closed position (i.e., the spring 60 urges the sealing surface 66 into engagement with the corresponding valve seat 54). The sealed, evacuated dispenser then may be sterilized, such as by applying gamma, e-beam or other radiation thereto.

The sterilized, sealed, evacuated dispensers then may be filled with a fluid or other substance, such as a medicament. As indicated in FIGS. 5A through 5D, the sterile filling machine further includes a fluid source 80 containing a fluid or other substance to be introduced into the storage chamber of the dispenser, such as a medicament (shown in FIG. 5A only) coupled in fluid communication with a filling member 74. The filling member 74 may be the same as the filling member described above, or may be a different filling member. For example, as described further below, the sterile filling machine may include more than one evacuating/filling member, such as a bank of evacuating/filling members, for evacuating a plurality of dispensers, and more than one filling member, such as a bank of filling members, for filling a plurality of dispensers with a fluid or other substance.

Figure 6A:
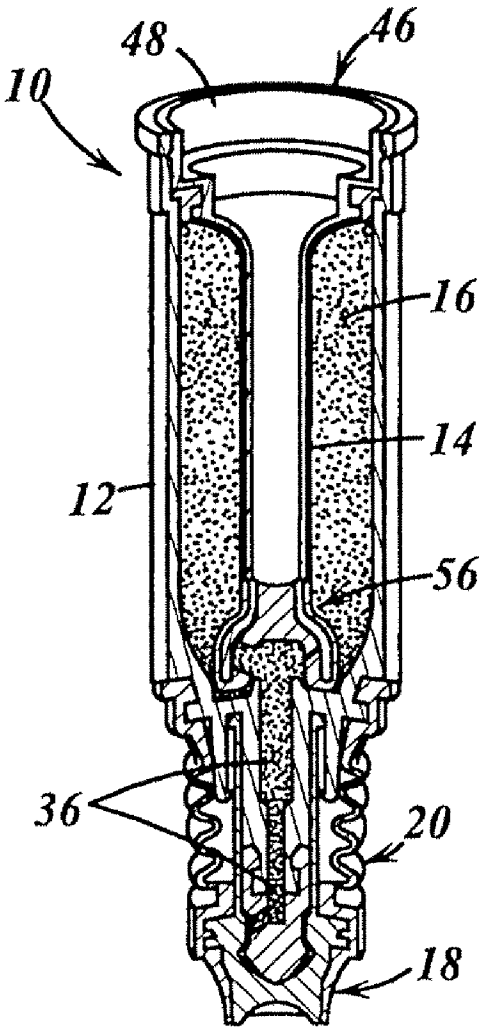
FIG. 6A is a perspective, cross-sectional view of the dispenser of FIG. 1 showing the storage chamber filled with a fluid or other substance, and the pump primed with such fluid or other substance.
Figure 6B:
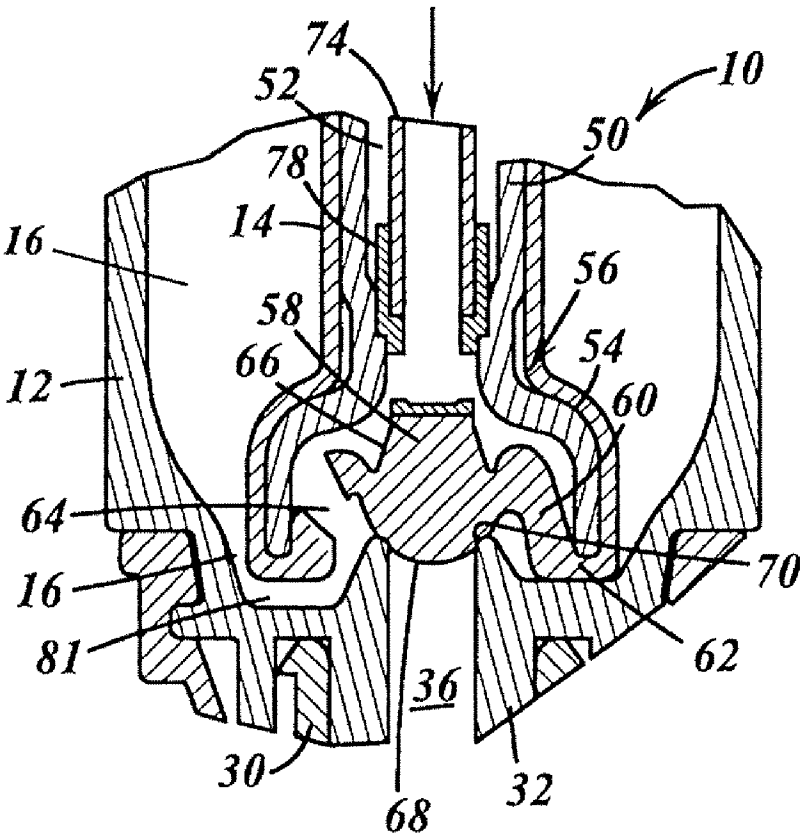
FIG. 6B is a partial, cross-sectional view of the dispenser of FIG. 1 showing the filling member engaging the flexible valve member in the fully open position and the storage chamber in the filled condition.

In order to fill the dispenser 10 with a fluid or other substance from the fluid source 80, the tip 78 of the filling member is moved axially inwardly against the valve member 58 of the filling valve 56 to open the valve. Preferably, as shown in FIG. 5D, the valve member 58 is moved axially inwardly until the second sealing surface 68 of the valve member sealingly engages the corresponding valve seat 70 to form a fluid-tight seal therebetween. Then, as also shown in FIG. 5D, fluid is introduced from the fluid source 80, through the open filling valve 56 and into the storage chamber 16. The base 62 of the bladder 14 defines one or more grooves 81 or like fluid passageways formed between the base of the bladder 14 and vial 12, and extending in fluid communication between the inlet aperture 64 of the filling valve and storage chamber 16. In the fully open position, the second sealing surface 68 and corresponding valve seat 70 prevent fluid from flowing into the piston, and thus prevent such fluid from flowing into the valve 18 during the filling, process. As shown in FIGS. 5B and 5C, as the fluid is filled into the storage chamber 16, the bladder 14 collapses and the variable volume chamber 16 correspondingly expands. As shown in FIG. 5C, in the filled position, the bladder 14 is collapsed toward, or in contact with, the fill tube 50. Once the storage chamber is filled, the filling member 74 is moved out of the fill tube 50 and the spring 60 of the filling valve 56 closes the valve member 58 to hermetically seal the fluid or other substance within the dispenser. As shown in FIG. 6A, upon withdrawing the filling member 74 and closure of the filling valve 56, the fluid or other substance within the storage chamber 16 is drawn into the formerly evacuated space of the piston conduit 36. As a result, the pump 20 will require at most minimal priming prior to dispensing the first dose of fluid or other substance therefrom.

Figures 7A, 7B, 7C, 7D:
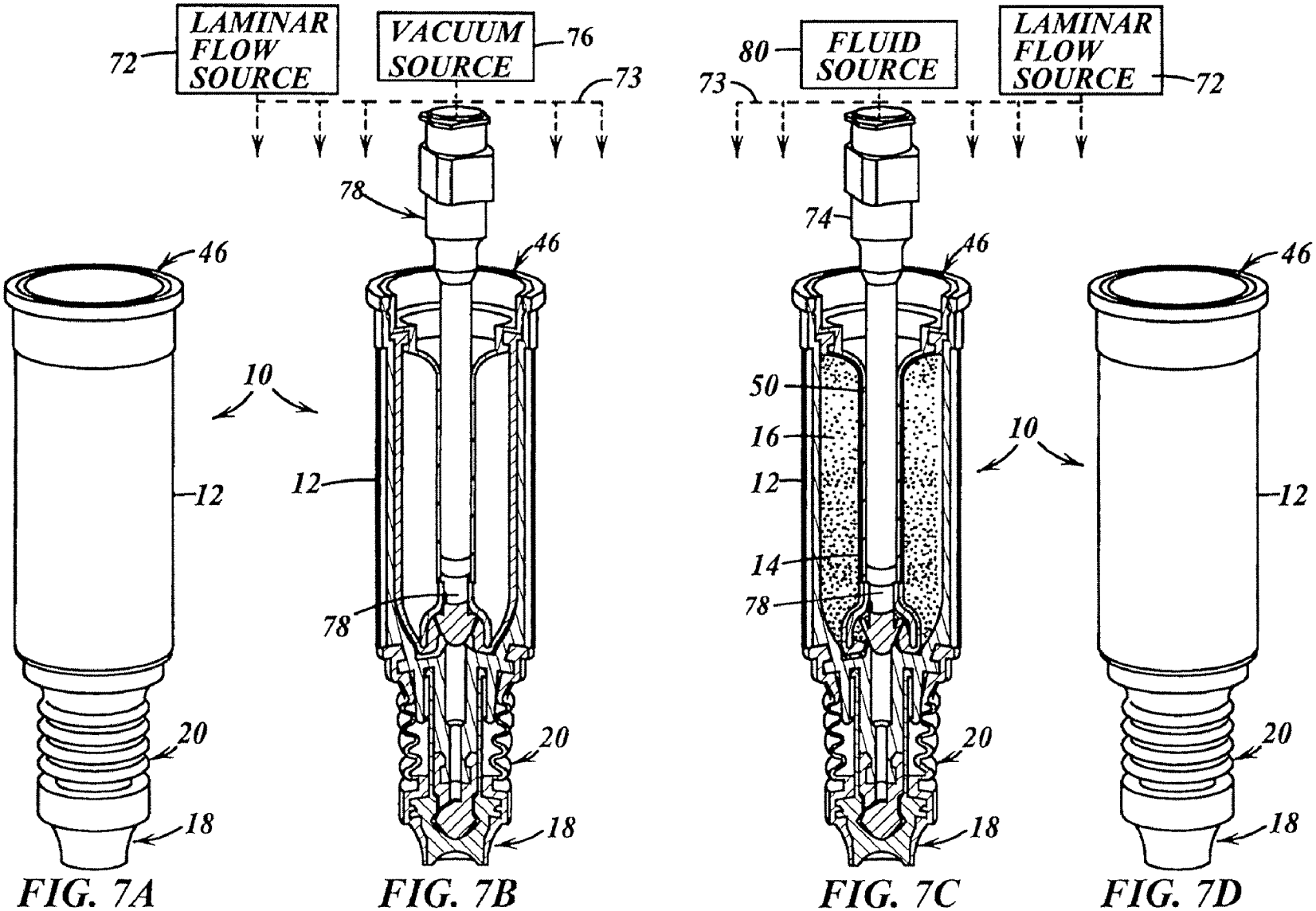
FIG. 7A is a perspective view of the dispenser of FIG. 1 in an empty, sealed, sterilized condition prior to introducing the dispenser into a sterile filling machine for filling the dispenser.
FIG. 7B is a perspective, cross-sectional view of the dispenser of FIG. 1 located in a vacuum station of a sterile filling machine and illustrating a filling/evacuating member received within the fill tube of the dispenser for evacuating the interior of the dispenser.
FIG. 7C is a perspective, cross-sectional view of the dispenser of FIG. 1 located in a filling station of a sterile filling machine, and illustrating a filling member received within the fill tube of the dispenser with the storage chamber in the filled condition and the flexible bladder in a correspondingly collapsed condition.
FIG. 7D is a perspective view of the dispenser of FIG. 1 showing the dispenser in an Intact™ condition wherein the dispenser is filled, sealed, sterilized and ready for discharge from the sterile filling machine.

In sum, and as shown typically in FIGS. 7A through 7D, the sealed, empty, sterilized dispensers 10 are introduced into the filling machine. Alternatively, if desired, the sealed, empty dispensers may be sterilized within the filling machine, such as by applying gamma and/or e-beam radiation thereto in a first stage of the sterile filling machine. As shown in FIG. 7B, the dispensers are first evacuated in a vacuum station. Then, as shown in FIG. 7C, the sealed, evacuated dispensers are filled in a filling station (both the vacuum and filling stations preferably include laminar flow to maintain aseptic conditions, as described above). If deemed necessary or desirable, an e-beam or other radiation source may be used to sterilize the exposed surface of the valve member 58 to further ensure sterilization of this surface prior to engagement of the surface with the evacuating/filling member. For example, as described further below, the evacuating and/or filling stations may be located within an e-beam chamber. Alternatively, a laser or other radiation source may be employed to scan or otherwise subject the exposed surface of the valve member 58 to radiation prior to passage through the evacuation and/or filling stations to further ensure the sterility of such surfaces. As shown in FIG. 7D, the Intact™ filled, sterilized, and hermetically sealed dispensers are discharged from the sterile filling machine and ready for usage.

Figure 7E:
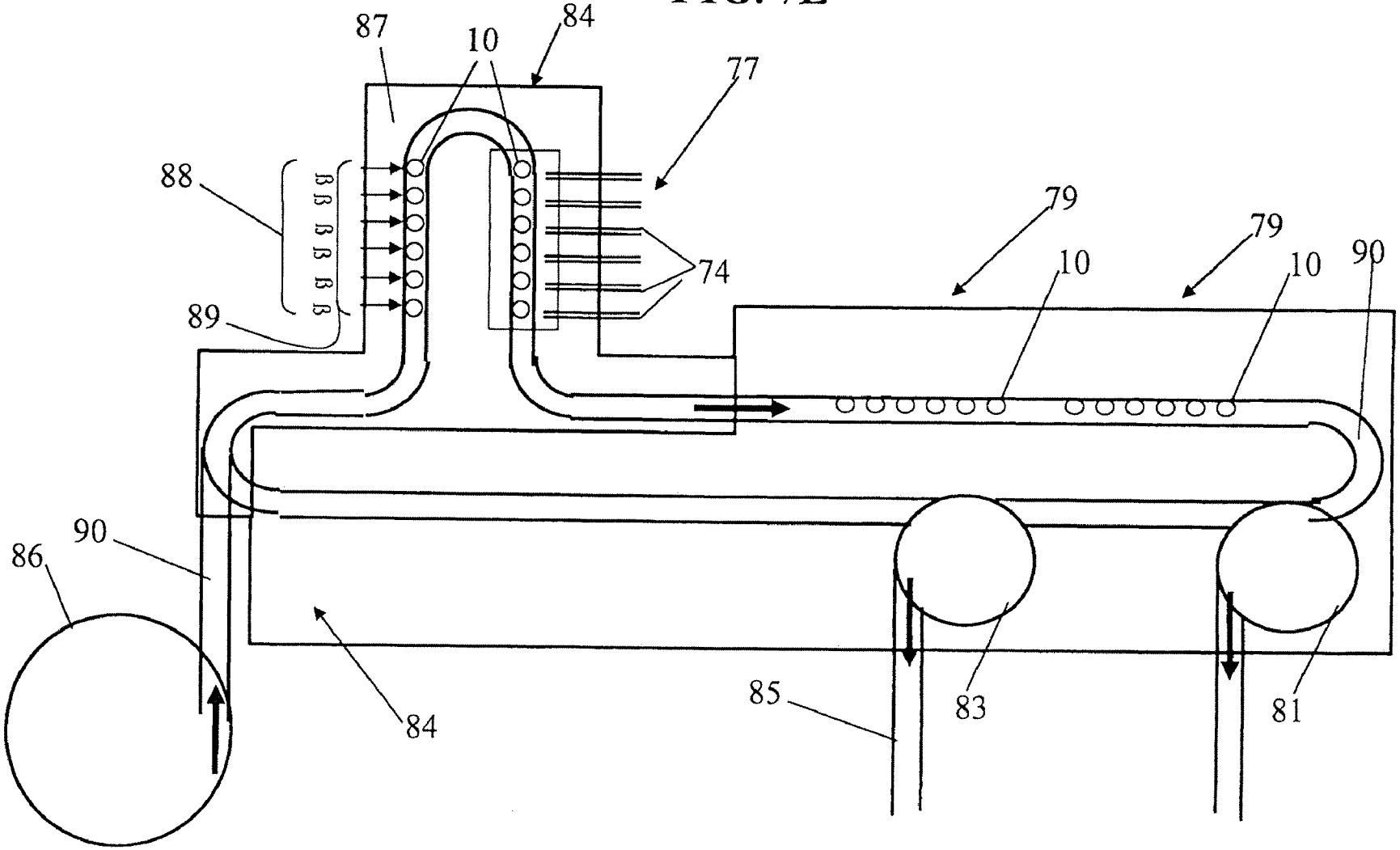
FIG. 7E is a somewhat schematic, top plan view of a sterile filling machine for use in filling the dispensers of the present invention.

With reference to FIG. 7E, in one embodiment of the present invention, the dispensers are filled in a sterile filling assembly including a sterile enclosure 84 and one or more laminar flow sources 72 (not shown in FIG. 7E) for providing a substantially laminar flow of filtered/sterilized air over the dispensers during the filling and/or transporting thereof. In the currently preferred embodiment of the invention, the sterile filling assembly is adapted to fill dispensers for containing medicaments, such as ophthalmic or other pharmaceutical or OTC products. However, as may be recognized by those of ordinary skill in the pertinent art based on the teachings herein, the sterile filling assembly equally may be used for filling any of numerous other substances, such as cosmetics and food products. The sterile filling assembly comprises an infeed unit 86 for holding the dispensers to be delivered into the enclosure 84 of the sterile filling assembly. In the illustrated embodiment, the infeed unit 86 is in the form of a rotary table that holds a plurality of dispensers, and delivers the dispensers at a predetermined rate into the sterile filling assembly. As may be recognized by those of ordinary skill in the pertinent art based on the teachings herein, the infeed unit may take the form of any of numerous devices that are currently known, or later become known for performing the functions of the infeed unit 86, such as any of numerous different types of vibratory feed drives, or "pick and place" robotic systems.

Prior to installing the dispensers on the infeed unit 86, the sealed empty dispensers are preferably sterilized, such as by exposing the containers to gamma radiation, in a manner known to those of ordinary skill in the pertinent art. In addition, the sealed, empty dispensers may be enclosed, sterilized, and transported to the sterile filling assembly in accordance with the teachings of U.S. Pat. No. 5,186,772, entitled "Method of Transferring Articles. Transfer Pocket And Enclosure", and U.S. patent application Ser. No. 10/421,249, entitled "Transfer Port and Method for Transferring Sterile Items", each of which is assigned to the assignee of the present invention and is hereby expressly incorporated by reference as part of the present disclosure.

Once loaded into the sterile filling assembly, the dispensers may be sterilized again (or alternatively, sterilized for the first time) by transmitting radiation from a radiation source 88 onto the sealed, empty dispensers in order to further ensure absolute sterility of the requisite surfaces prior to filling. The radiation may take the form of any of numerous different types of radiation that are currently or later become known for performing this function, such as gamma, e-beam and/or laser radiation.

A conveyor 90 is coupled to the infeed unit 86 for receiving the dispensers delivered by the infeed unit and for transporting the dispensers at a predetermined rate through the sterile filling assembly. In the illustrated embodiment of the present invention, the conveyor 90 preferably transports the dispensers in a single file relative to each other. The conveyor 90 may take the form of any of numerous different types of conveyers that are currently, or later become known, for performing the functions of the conveyor described herein. For example, the conveyor may take the form of a vibratory feed drive, or may take the form of an endless conveyor belt, or a plurality of star wheels, including, for example, a plurality of receptacles, such as cleats, for receiving or otherwise holding the dispensers at predetermined positions on the conveyor. The conveyor is drivingly connected to a motor or other suitable drive source (not shown), which is controlled by a computer or other control unit (not shown) to start, stop, control the speed, and otherwise coordinate operation of the conveyor with the other components of the sterile filling assembly.

In one embodiment of the present invention, the radiation source 88 includes at least one e-beam source mounted within an e-beam housing 87 containing therein a filling station 77 including a bank or plurality of filling members 74. The e-beam source 88 may be any of numerous different types of e-beam sources that are currently, or later become known, for performing the function of the e-beam source described herein. E-beam radiation is a form of ionizing energy that is generally characterized by its low penetration and high dose rates. The electrons alter various chemical and molecular bonds upon contact with an exposed product, including the reproductive cells of microorganisms, and therefore e-beam radiation is particularly suitable for sterilizing dispensers or other containers for medicaments or other sterile substances. As indicated by the arrows in FIG. 7E, the e-beam source 88 produces an electron beam 89 that is formed by a concentrated, highly charged stream of electrons generated by the acceleration and conversion of electricity. Preferably, the electron beam 89 is focused onto the surfaces of the dispensers that will contact or be located in close proximity to the filling members 74 and onto the surfaces of the filling members 74. In addition, reflective surfaces (not shown) may be mounted adjacent to the conveyor in a manner known to those of ordinary skill in the pertinent art in order to reflect the e-beam, and/or the reflected and scattered electrons of the e-beam, onto the surfaces of interest of the dispensers and/or filling members to ensure adequate sterility of same. Alternatively, or in combination with such reflective surfaces, more than one e-beam source may be employed, wherein each e-beam source is focused onto a respective surface or surface portion of the dispensers and/or filling members to ensure sterilization of each surface area of interest.

The e-beam housing is constructed in a manner known to those of ordinary skill in the pertinent art to define an e-beam chamber and means for preventing leakage of the electrons out of the chamber in accordance with applicable safety standards. In one embodiment of the present invention, the conveyor 90 defines an approximately U-shaped path within the e-beam chamber 87, wherein the first leg of the U defines an inlet section and the portion of the chamber onto which the e-beam is directed. However, as may be recognized by those of ordinary skill in the pertinent art based on the teachings herein, the e-beam may be directed throughout the chamber and/or to other portions of the chamber. Preferably, the current, scan width, position and energy of the e-beam 89, the speed of the conveyor 90, and/or the orientation and position of any reflective surfaces, are selected to achieve at least a 3 log reduction, and preferably about a 6 log reduction in bioburden testing on the requisite surfaces of the dispensers and/or filling members. In addition, as an added measure of caution, one or more of the foregoing variables also are preferably selected to achieve at least a 3 log reduction on the sides or other non-contact surfaces of the dispensers and non-contact surfaces of the filling members. These specific levels of sterility are only exemplary, however, and the sterility levels may be set as desired or otherwise required to validate a particular product under, for example, United States FDA or applicable European standards, such as the applicable Sterility Assurance Levels ("SAL").

The sterile filling assembly 84 also preferably includes means for visually inspecting the filling station 77. This means may take the form of a beta-barrier window (i.e., a window that blocks any e-beam radiation but permits visual inspection therethrough), and/or a CCD, video or other camera mounted within the housing for transmitting to an external monitor images of the filling station. As may be recognized by those skilled in the pertinent art based on the teachings herein, these particular devices are only exemplary, and any of numerous other devices that are currently known, or later become known, for performing the function of permitting visual inspection equally may be employed.

The filling station 77 is located on the opposite leg, or outlet side of the U-shaped conveyor path within the e-beam chamber. In one embodiment of the present invention, the filling station 77 includes a plurality of filling members 74 mounted over the conveyor 90, wherein each filling member is drivingly mounted over the conveyor in the same manner as described above. The same filling member may be used to evacuate and to fill the dispensers, or the station may include separate banks of filling members for first evacuating and then filling the dispensers. In this configuration, the filling members used to evacuate the dispensers may be located on the inlet leg of the chamber, and the filling members used to fill the dispensers may be located on the outlet leg of the chamber. Accordingly, each filling member 74 is movable into and out of engagement with the valve members 58 of the dispensers received within the filling station to evacuate and/or fill the dispensers with a medicament or other substance to be contained therein, and to then withdraw the filling member upon filling the dispensers. In one embodiment, the filling station includes a bank of six filling members 74 mounted in line with each other and overlying the conveyor 90 to allow the simultaneous in-line evacuation and then filling of six dispensers. The filling members 74 may be mounted to a common drive unit (not shown), or each filling member may be individually actuatable into and out of engagement with the valve members of the dispensers. As may be recognized by those of ordinary skill in the pertinent art based on the teachings herein, the filling station may include any desired number of filling members, or may be mounted or driven in any of numerous different ways that are currently known, or later become known, for performing the functions of the filling station described herein. Similarly, the sterile filling assembly may include a plurality of filling stations mounted within the same e-beam chamber, or a plurality of e-beam and filling assemblies, in order to increase or otherwise adjust the overall throughput of the sterile filling assembly. Preferably, the e-beam housing 87 defines a port or other removable passageway (not shown) to allow access to and/or repair and replacement of the filling station 77.

As described above, the e-beam and filling station is configured so that the filling members 74 are mounted within the e-beam chamber 87. As a result, the free electrons within the e-beam chamber will impinge upon the filling members. This, in combination with operation of the e-beam 89 which sterilizes the air throughout the e-beam chamber 87, functions to sterilize the filling members and/or maintain the sterility of the filling members throughout the filling process. Accordingly, since the containers or other dispensers are evacuated and filled within the e-beam chamber 87, there is virtually no risk that the dispensers will become contaminated between e-beam sterilization and filling. If desired, the air within the e-beam chamber may be ionized to promote multiplication of the free electrons and further enhance the sterility of the filling station 77. Furthermore, this feature of the invention obviates any need for an isolator, as found in many prior art sterile filling machines.

The e-beam source 88 and other applicable components of the e-beam chamber, conveyor systems, and filling assembly may be the same or similar to that disclosed in the following co-pending patent applications which are assigned to the Assignee of the present invention and hereby incorporated by reference as part of the present disclosure: U.S. application Ser. No. 10/600,525, entitled "Sterile Filling Machine Having Needle Filling Station Within E-Beam Chamber"; U.S. provisional application Ser. No. 60/518,267, filed Nov. 7, 2003, entitled "Needle Filling and Laser Sealing Station"; and U.S. provisional application Ser. No. 60/518,685, filed Nov. 10, 2003, entitled "Needle Filling and Laser Sealing Station".

As shown in FIG. 7E, the sterile filling assembly may include one or more additional stations 79 located downstream of the filling station 77. The additional stations 79 may include a vision system of a type known to those of ordinary skill in the pertinent art for inspecting each valve seal, a level detection system for detecting the level of fluid or other substance within each dispenser to ensure that it is filled to the correct level, and a labeling station. In addition, as shown in FIG. 7E, the sterile filling assembly may include a rejection unit 81 for pulling off of the conveyer any dispensers that are defective as detected, for example, by the level detection inspection, or due to mislabeling or defective labeling. Then, the acceptable dispensers are removed by a discharge unit 83 for discharging the dispensers into a collection unit 85 for packing and shipping. The rejection and discharge units may take the forms of star wheels, pick and place robots, or any of numerous other devices that are currently or later become known for performing the functions of these units described herein.

A significant advantage of the currently preferred embodiments of the present invention is that they enable true sterile filling and not only aseptic filling. Yet another advantage of the currently preferred embodiments of the present invention is that the medicament or other substance is filled after subjecting the dispensers to gamma and direct e-beam radiation, thus preventing the radiation from degrading the medicament or other substance to be contained within the dispenser.

Yet another advantage of the dispensers of the present invention is that they may hold multiple doses of fluids or other substances, such as medicaments. A further advantage of the dispensers of the present invention is that the fluids may be preservative free.

Figure 8:
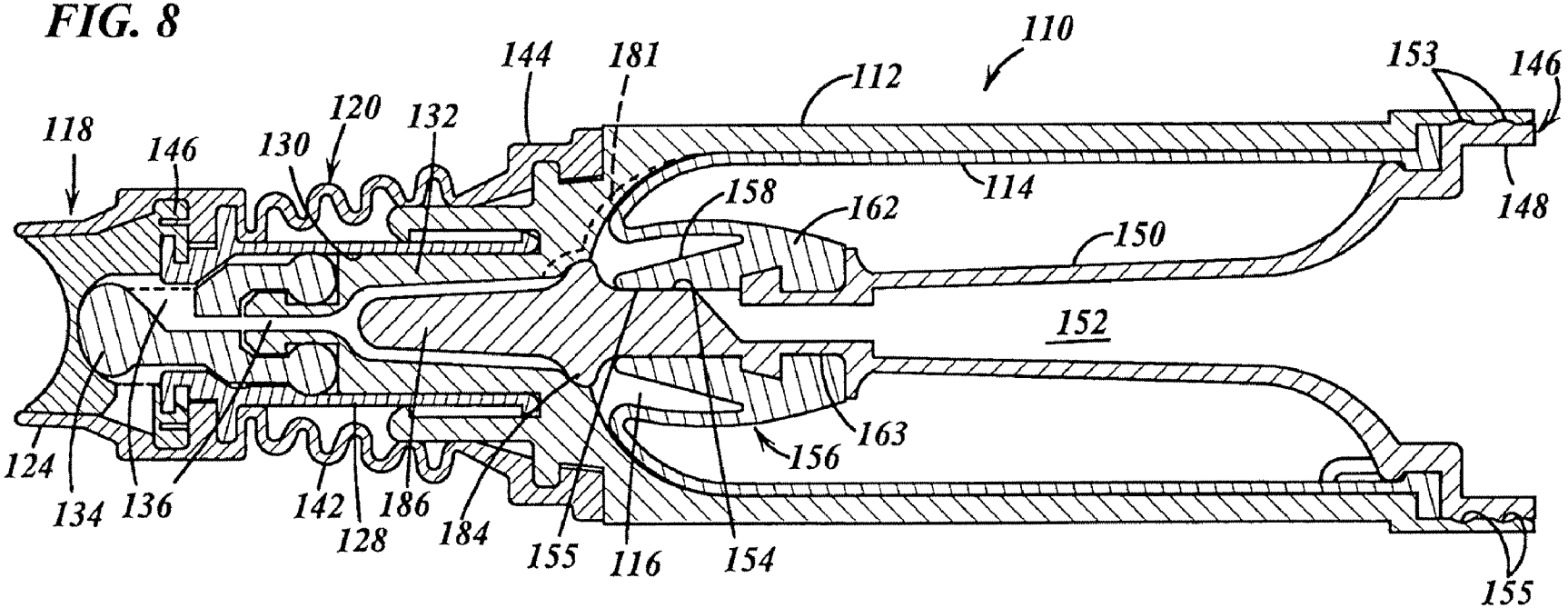
FIG. 8 is a cross-sectional view of another dispenser embodying the present invention including a different type of filling valve.

In FIG. 8, another dispenser embodying the present invention is indicated generally by the reference numeral 110. The dispenser 110 is similar to the dispenser 10 described above with reference to FIGS. 1-7, and therefore like reference numeral preceded by the numeral 1 are used to indicate like elements. A primary difference of the dispenser 110 in comparison to the dispenser 10 is in the construction of the filling valve 156. As shown in FIG. 8, the free end of the fill tube 150 defines an axially-extending valve seat 154, and the base portion 162 of the flexible bladder 114 defines a flexible valve cover 158 that overlies the valve seat 154 to thereby define an annular, axially-extending seam 155 therebetween. Preferably, the flexible valve cover 158 and valve seat 154 form an interference fit to thereby maintain a fluid-tight seal when the valve is in the normally closed position. The fill tube 150 defines an annular recess 163 that fixedly receives therein a corresponding annular lobe formed by the base portion 162 of the bladder. The flexible valve cover 158 preferably defines a substantially tapered, or progressively reduced wall thickness when moving axially in the direction of the inlet to the valve toward the interior of the dispenser. This configuration requires progressively less energy to open each respective annular portion of the valve when moving axially from the inlet to the valve to the interior of the dispenser. As a result, once the base of the valve is opened, the pressure is sufficient to cause the respective axial segments of the valve cover 158 to progressively open and then close after passage of fluid therethrough when moving in the axial direction. Preferably a substantially annular segment of the valve cover 158 substantially always engages the valve seat 154 to maintain the fluid-tight seal across the valve 156 and thereby prevent ingress through the valve of germs, bacteria or other substances. The tip of the fill tube 150 defines an annular flange 184 that is seated in a corresponding recess formed in the base of the vial body 112, and a tip 186 that is received within the piston 132 to define the piston fluid conduit 136 therebetween.

Figures 9A, 9B, 9C, 9D:
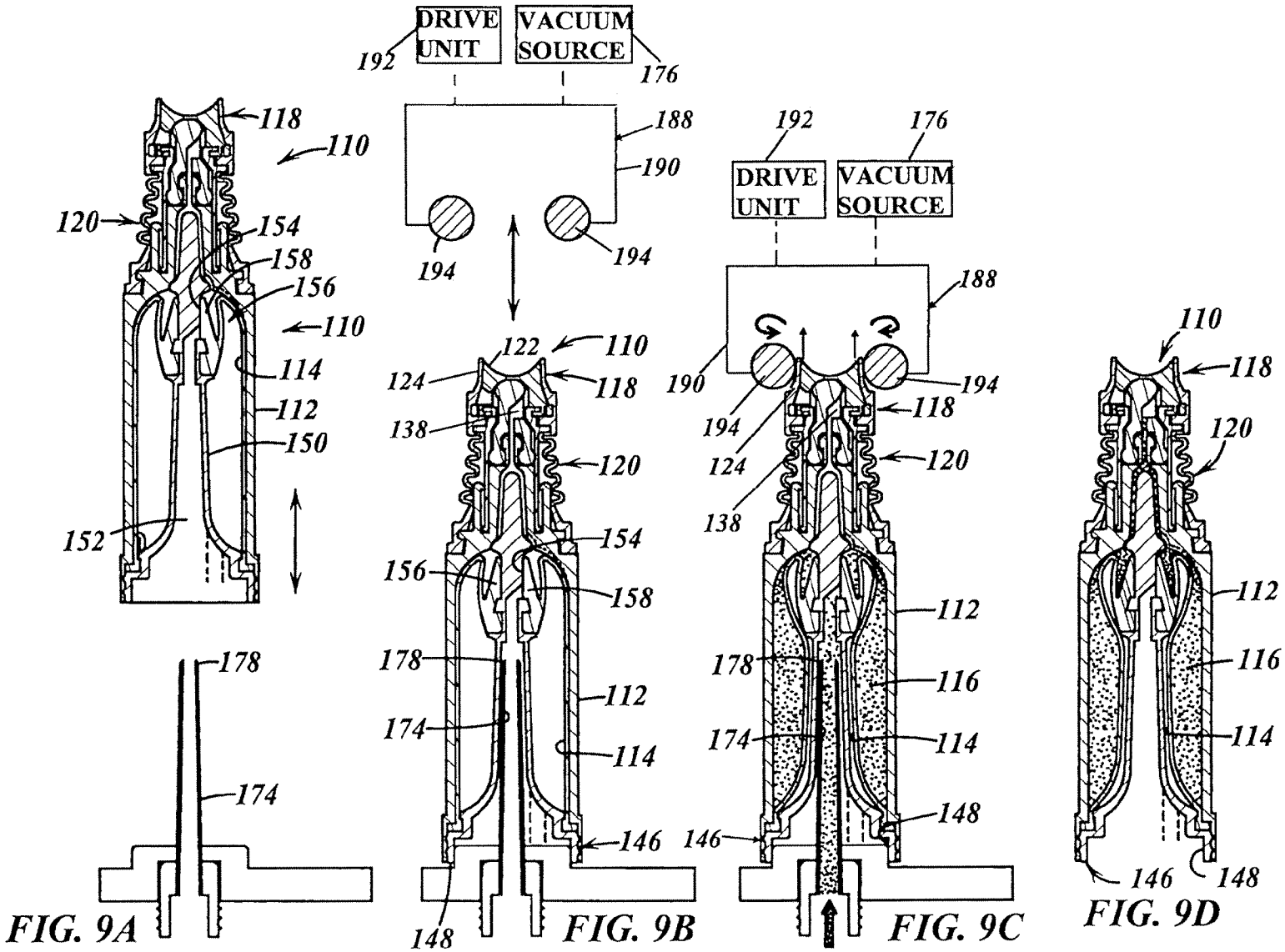
FIG. 9A is cross-sectional view of the dispenser of FIG. 8 being loaded into the filling station of a sterile filling machine.
FIG. 9B is a cross-sectional view of the dispenser of FIG. 8 in the filling station of a sterile filling machine.
FIG. 9C is a cross-sectional view of the dispenser of FIG. 8 being filled in the filling station of a sterile filling machine.
FIG. 9D is a cross-sectional view of the dispenser of FIG. 8 after filling in the sterile filling machine and ready for use.

As shown in FIGS. 9A and 9B, the dispenser 110 is filled by slidably receiving a probe 174 within the fill tube 150 such that the tip 178 of the probe is located adjacent to the inlet to the filling valve 156. As shown in FIGS. 9B and 9C, a fixture 188 is movable into engagement with the dispensing valve 118 to evacuate the interior of the dispenser and otherwise to secure the dispenser in the filling station. The fixture 188 includes a housing 190 coupled in fluid communication with a vacuum source 176, and drivingly connected to a drive unit 192 for moving the fixture into and out of engagement with the dispensing nozzle 118 of the respective dispenser 110. The fixture 188 further includes at least two rotating members 194 angularly spaced relative to each other and engageable with the flexible valve cover 124 of the dispensing nozzle. As indicated by the arrows in FIG. 9C, the rotating members 194 are rotatably driven when placed in contact with the flexible valve cover 124 of the respective dispensing nozzle 118 to compress or pinch a portion of the valve cover located between the rotating members and, in turn, form an opening between the valve cover 124 and respective valve seat 122 coupled in fluid communication with the dosage chamber 138 and interior of the dispenser. The vacuum source 176 is coupled in fluid communication through the fixture housing 190 to the opening formed by the rotating members 194 to, in turn, evacuate the interior of the dispenser through the opening. Once the interior of the dispenser is evacuated, the rotating members 194 are rotated in the opposite direction and/or are released to allow the flexible valve cover to return to its normally-closed position to hermetically seal the evacuated dispenser.

As indicated by the arrow in FIG. 9C, after evacuating the dispenser and returning the dispensing valve to its closed position, fluid is introduced through the probe 174, through the seam 155 of the filling valve 156, through the passageway(s) 181, and into the storage chamber 116. The fluid is introduced through the probe 174 at a pressure greater than the valve opening pressure of the filling valve 156 to open the valve and allow the fluid to flow therethrough. As shown in FIG. 9C, as the storage chamber 116 is filled with fluid, the bladder 114 correspondingly collapses to allow the variable volume chamber 116 to correspondingly expand and receive the fluid. As shown in FIG. 9D, once the storage chamber 116 is filled with fluid, the probe 174 is released, and the flexible valve cover 158 seals against the valve seat 154 to hermetically seal the fluid within the dispenser. If desired, the filling steps illustrated in FIGS. 9A through 9C may be performed within an e-beam chamber as described above in connection with FIG. 7E.

Figure 10:
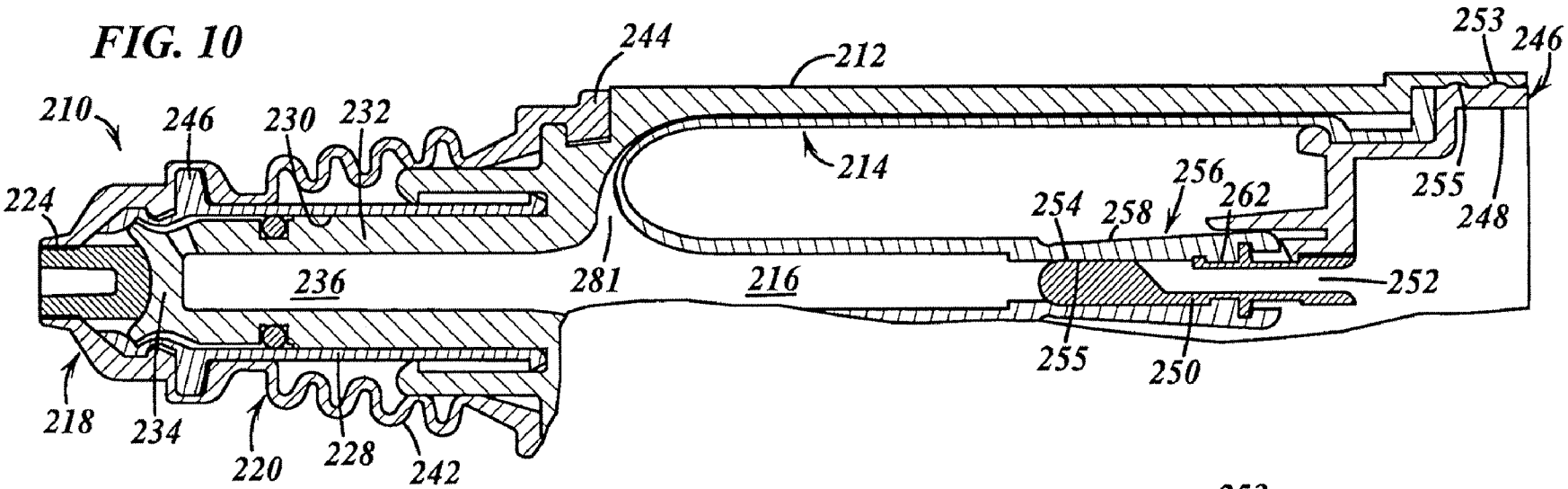
FIG. 10 is a partial, cross-sectional view of another dispenser embodying the present invention including a different type of filling valve.
Figure 11:
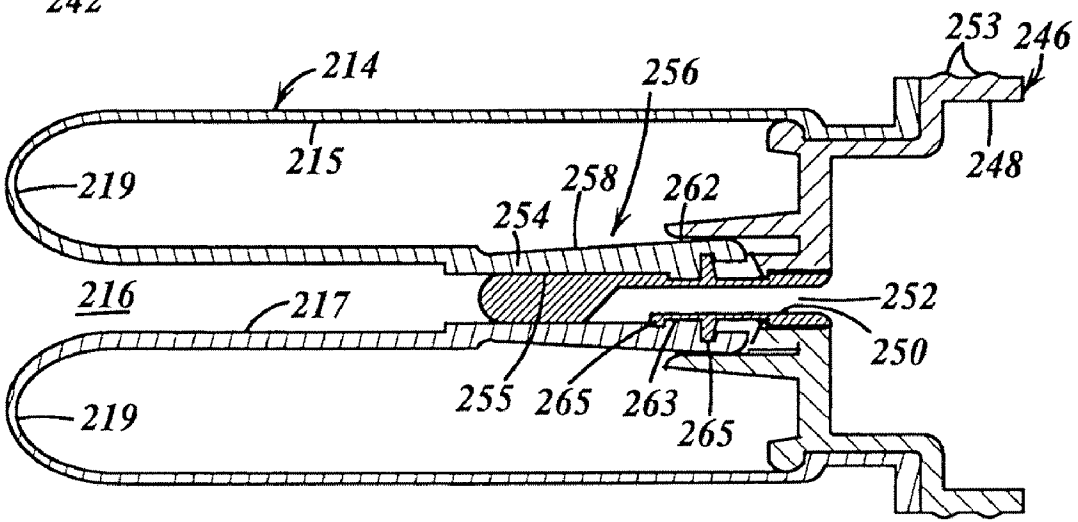
FIG. 11 is cross-sectional view of the flexible bladder of the dispenser of FIG. 10.

In FIGS. 10 and 11, another dispenser embodying the present invention is indicated generally by the reference numeral 210. The dispenser 210 is similar to the dispenser 10 described above with reference to FIGS. 1-7, and therefore like reference numerals preceded by the numeral 2 are used to indicate like elements. A primary difference of the dispenser 210 in comparison to the dispenser 10 is in the construction of the filling valve 256 and flexible bladder 214.

As shown in FIGS. 10 and 11, the flexible bladder 214 defines in its expanded condition an exterior axially-extending cylindrical wall 215, an interior axially-extending cylindrical wall 217, and a curvilinear base portion 219 extending between the interior and exterior cylindrical walls. The free end of the fill tube 250 defines an axially-extending valve seat 254, and the base portion 262 of the inner wall 217 of the flexible bladder 214 defines a flexible valve cover 258 that overlies the valve seat 254 to thereby define an annular, axially-extending seam 255 therebetween. Preferably, the flexible valve cover 258 and valve seat 254 form an interference fit to thereby maintain a fluid-tight seal when the valve is in the normally closed position. The fill tube 250 defines an annular recess 263 that fixedly receives therein a corresponding annular lobe formed by the base portion 262 of the bladder. Annular flanges 265 extend outwardly from the fill tube 250 on either side of the annular recess 263, and are received within corresponding annular recesses formed in the base portion 262 of the inner wall of the bladder to fixedly secure the bladder and valve cover to the fill tube.

The flexible valve cover 258 preferably defines a substantially tapered or progressively reduced wall thickness when moving axially in the direction of the inlet to the valve toward the interior of the dispenser. This configuration requires progressively less energy to open each respective annular portion of the valve when moving axially from the inlet to the valve to the interior of the dispenser. As a result, once the base of the valve 256 is opened, the pressure is sufficient to cause the respective axial segments of the valve cover 258 to progressively open and then close after passage of fluid therethrough when moving in the axial direction. Preferably a substantially annular segment of the valve cover 258 substantially always engages the valve seat 254 to maintain the fluid-tight seal across the valve 256 and thereby prevent ingress through the valve of germs, bacteria or other substances.

The dispenser 210 is filled by initially evacuating the dispenser as described above, and then slidably receiving a probe (not shown) within the fill tube 250 such that the tip of the probe is located adjacent to the inlet to the filling valve 256. Then, fluid is introduced through the probe, through the seam 255 of the filling valve 256, and into the storage chamber 216. The fluid is introduced through the probe at a pressure greater than the valve opening pressure of the filling valve 256 to open the valve and allow the fluid to flow therethrough. As the storage chamber 216 is filled with fluid, the exterior wall 215 of the bladder 214 correspondingly collapses toward the interior wall 217 to allow the variable volume chamber 216 to correspondingly expand and receive the fluid. Once the storage chamber 216 is filled with fluid, the probe is released, and the flexible valve cover 258 seals against the valve seat 254 to hermetically seal the fluid within the dispenser.

A significant advantage of the illustrated embodiments of the present invention is that the dispensers may hold multiple doses of substances and store the substance remaining within the dispenser in a hermetically sealed, sterile condition between doses. Accordingly, in a currently preferred embodiment of the present invention, the substance shown is a non-preserved product. Because the variable-volume storage chamber maintains the substance in a sterile, hermetically sealed condition, from the first to the last dose, the use of preservatives may be avoided.

As may be recognized by those of ordinary skill in the pertinent art based on the teachings herein, numerous changes and modifications may be made to the above-described and other embodiments of the present invention without departing from the spirit of the invention as defined in the claims. For example, the components of the dispensers may be made of any of numerous different materials that are currently or later become known for performing the functions of such components. Similarly, the components of the dispensers may take any of numerous different shapes and/or configurations. Also, the dispensers may be used to dispense any of numerous different types of fluids or other substances for any of numerous different applications, including, for example, ophthalmic, nasal, dermatological, or other pharmaceutical or OTC applications. Further, the sterile filling machine used to fill the dispensers of the present invention may take any of numerous different configurations that are currently, or later become known for filling the dispensers in accordance with the teachings of the present invention. Such sterile filling machines may vary significantly from the filling machine disclosed herein. For example, the filling machines may have any of numerous different mechanisms for sterilizing, feeding, evacuating and/or filling the dispensers. Further, as indicated above, the same filling members or probes may be equipped to both evacuate the dispensers and fill the dispensers in the same station. Further, the filling valve need not be formed through the bladder, but may extend through the vial body or otherwise may be coupled in fluid communication with the storage chamber to evacuate and/or fill the storage chamber. Alternatively, the dispenser may include one valve for evacuating the interior of the dispenser and another valve for filling the storage chamber of the dispenser. Similarly, the pump and/or dispensing valve each may take a configuration that is different than that disclosed herein. In addition, the variable-volume storage chamber may not be formed by a flexible bladder, but rather may be formed by a piston slidably received within the vial body, as described, for example, in the above-mentioned co-pending patent application. Accordingly, this detailed description of currently preferred embodiments is to be taken in an illustrative, as opposed to a limiting sense.

What is claimed is:

1. A dispenser comprising:

a body;

a storage chamber within the body;

a first valve coupled in fluid communication with the storage chamber and defining (1) a normally closed, fluid-tight position hermetically sealing the storage chamber from the ambient atmosphere, and (2) an open position allowing the passage of fluid through the valve to at least one of withdraw fluid therethrough to evacuate the storage chamber, and to introduce fluid therethrough to fill the storage chamber; and a second valve coupled in fluid communication with the storage chamber and defining (1) a normally closed, fluid-tight position preventing the passage of fluid therethrough, and (2) an open position for dispensing fluid therethrough.

2. A dispenser as defined in claim 1, further comprising a pump coupled in fluid communication with the storage chamber for pumping fluid out of the storage chamber.

3. A dispenser as defined in claim 1, wherein the first valve includes a flexible valve member movable between the closed and open positions, wherein the flexible valve member is biased toward the closed position.

4. A dispenser as defined in claim 3, wherein the first valve further includes a valve seat engageable with the flexible valve member in the closed position to form a fluid-tight seal therebetween.

5. A dispenser as defined in claim 4, wherein the valve member at least one of (i) forms an interference fit with the valve seat, (ii) defines a progressively decreasing wall thickness in a direction from the inlet toward the outlet of the valve, and (iii) defines a configuration such that the energy required to open portions of the valve cover progressively decreases in a direction from the inlet toward the outlet of the valve.

6. A dispenser as defined in claim 1, wherein the first valve includes at least one valve seat and at least one sealing surface movable relative to the at least one valve seat between closed and open positions, wherein in the closed position the at least one sealing surface engages the at least one valve seat to form a fluid-tight seal therebetween, and in the open position the at least one sealing surface is spaced away from the at least one valve seat to form a valve opening for the passage of fluid therethrough.

7. A dispenser as defined in claim 1, wherein the second valve includes a valve seat, and a flexible valve cover overlying the valve seat and forming a fluid-tight seal therebetween.

8. A dispenser as defined in claim 7, wherein the valve cover at least one of (i) forms an interference fit with the valve seat, (ii) defines a progressively decreasing wall thickness in a direction from the inlet toward the outlet of the valve, and (iii) defines a configuration such that the energy required to open portions of the valve cover progressively decreases in a direction from the inlet toward the outlet of the valve.

9. A dispenser as defined in claim 1, wherein the storage chamber is defined by a flexible bladder.

10. A dispenser as defined in claim 1, wherein the storage chamber includes at least one of a cosmetic, medicament, food product, sterile fluid and preservative free fluid.

11. A dispenser as defined in claim 1, further comprising a fill port coupled in fluid communication with the first valve.

12. An apparatus for sterile filling including a dispenser as defined in claim 11, and at least one filling member engageable with the first valve to at least one of withdraw fluid from the dispenser through the first valve and introduce fluid from the filling member and into the storage chamber of the dispenser.

13. An apparatus as defined in claim 12, wherein the first valve includes a valve member engageable with the filling member and movable therewith between the closed and open positions.

14. An apparatus as defined in claim 12, further comprising a vacuum source coupled in fluid communication with the at least one filling member for drawing a vacuum through the filling member and, in turn, through a dispenser coupled in fluid communication with the filling member.

15. An apparatus as defined in claim 12, further comprising a fluid source coupled in fluid communication with the at least one filling member for introducing fluid therethrough and into the storage chamber of a dispenser coupled in fluid communication therewith.

16. An apparatus as defined in claim 15, wherein the fluid source comprises at least one of medicament, a cosmetic, food product, sterile fluid and preservative free fluid.

17. An apparatus as defined in claim 12, further comprising a laminar flow source for introducing a substantially laminar flow of fluid over the at least one filling member and dispenser coupled in fluid communication therewith.

18. A dispenser comprising:

a body;

a storage chamber within the body;

first means coupled in fluid communication with the storage chamber for (1) forming a normally closed, fluid-tight seal hermetically sealing the storage chamber from the ambient atmosphere, and (2) forming an opening allowing the passage of fluid therethrough to at least one of evacuate the storage chamber and introduce fluid into the storage chamber; and second means coupled in fluid communication with the storage chamber for (1) forming a normally closed, fluid-tight seal preventing the passage of fluid therethrough, and (2) forming an opening for dispensing fluid therethrough.

19. A dispenser as defined in claim 18, wherein the first means includes a flexible valve member movable between closed and open positions, and biased toward the closed position.

20. A dispenser as defined in claim 18, wherein the second means includes a valve seat, and a flexible valve cover overlying valve seat and forming a fluid-tight seal therebetween.

21. A dispenser as defined in claim 18, wherein the first means includes a valve seat, and a flexible valve cover overlying valve seat and forming a fluid-tight seal therebetween.

22. A method for filling a dispenser, wherein the dispenser includes a body; a storage chamber; a first valve coupled in fluid communication with the storage chamber and defining (1) a normally closed, fluid-tight position hermetically sealing the storage chamber, and (2) an open position allowing the passage of fluid through the valve to at least one of withdraw fluid therethrough to evacuate the storage chamber, and to introduce fluid therethrough to fill the storage chamber; and a second valve coupled in fluid communication with the storage chamber and defining (1) a normally closed, fluid-tight position preventing the passage of fluid therethrough, and (2) an open position for dispensing fluid therethrough; the method comprising the following steps:

(i) providing a filling member coupled in fluid communication with a fluid source;

(ii) connecting the filling member in fluid communication with the first valve;

(iii) introducing fluid from the filling member through the first valve and into the storage chamber; and (iv) withdrawing the filling member from the first valve and hermetically sealing the fluid within the storage chamber.

23. A method as defined in claim 22, further comprising the step of evacuating the storage chamber.

24. A method as defined in claim 23, wherein the evacuating step includes: moving an evacuating member coupled in fluid communication with a vacuum source into contact with the first valve, and drawing vacuum through the evacuating member and, in turn, evacuating the storage chamber of the dispenser.

25. A method as defined in claim 24, wherein the filling member is used as the evacuating member.

26. A method as defined in claim 23, wherein the evacuating step includes evacuating the storage chamber through the second valve.

27. A method as defined in claim 22, further comprising the step of providing a substantially laminar flow of fluid over the filling member and dispenser coupled in fluid communication therewith.

28. A method as defined in claim 22, further comprising the step of sealing the second valve from the storage chamber during filling of the storage chamber to prevent a flow of fluid through the second valve during filling of the storage chamber.

29. A method as defined in claim 22, wherein the fluid includes at least one of medicament, a cosmetic, food product, sterile fluid and preservative free fluid.

30. A method as defined in claim 22, further comprising directing e-beam radiation onto at least one of a portion of the dispenser and a portion of the filling member.

31. A method as defined in claim 22, further comprising the step of sterilizing the sealed, empty dispenser prior to filling the dispenser.

* * * * *